US010724181B2

(12) United States Patent
Fanucci et al.

(10) Patent No.: US 10,724,181 B2
(45) Date of Patent: Jul. 28, 2020

(54) MODULAR BLOCK SYSTEM FOR ROUNDABOUTS

(71) Applicant: ZKxKZ, LLC, Lexington, MA (US)

(72) Inventors: Jerome P. Fanucci, Lexington, MA (US); Aram Stepanian, Seattle, WA (US); Adam Lanik, San Diego, CA (US)

(73) Assignee: ZKxKZ, LLC, Lexington, MA (US)

( * ) Notice: Subject to any disclaimer, the term of this patent is extended or adjusted under 35 U.S.C. 154(b) by 0 days.

(21) Appl. No.: 15/758,947

(22) PCT Filed: Sep. 9, 2016

(86) PCT No.: PCT/US2016/050932

§ 371 (c)(1),
(2) Date: Mar. 9, 2018

(87) PCT Pub. No.: WO2017/044734

PCT Pub. Date: Mar. 16, 2017

(65) Prior Publication Data

US 2019/0040589 A1 Feb. 7, 2019

Related U.S. Application Data

(60) Provisional application No. 62/217,412, filed on Sep. 11, 2015.

(51) Int. Cl.
*E01C 1/02* (2006.01)
*E01F 1/00* (2006.01)
(Continued)

(52) U.S. Cl.
CPC ..... *E01C 1/02* (2013.01); *E01C 5/00* (2013.01); *E01C 5/20* (2013.01); *E01C 5/22* (2013.01);
(Continued)

(58) Field of Classification Search
CPC ..... E01C 1/02; E01C 5/00; E01C 5/20; E01C 5/22; E01C 11/00; E01C 11/221; E01C 19/52; E01F 1/00
See application file for complete search history.

(56) References Cited

U.S. PATENT DOCUMENTS 4,697,294 A * 10/1987 Schafer ..... E01C 5/005 14/69.5
5,170,606 A * 12/1992 Popp ..... F16B 13/141 411/452
(Continued)

FOREIGN PATENT DOCUMENTS

AU 2009208047 A1 2/2011
DE 10118012 A1 10/2002
(Continued)

OTHER PUBLICATIONS

RTL, "Rubber Roundabouts", Jan. 22, 2015, http://rtl.co.nz/c/Car-Park-Solutions--Traffic-Calming/p/829/Rubber-Roundabouts.aspx (Year: 2015).*
(Continued)

*Primary Examiner* — Abigail A Risic
(74) *Attorney, Agent, or Firm* — Verrill Dana, LLP

(57) ABSTRACT

A roundabout for vehicular traffic is provided from a plurality of modular blocks arranged in a generally circular roundabout pattern and affixed to a roadway or ground surface at an intersection of vehicle roadways. Roundabouts can be formed in any desired diameter. In some embodiments, the modular blocks can have a trapezoidal plan shape laid out in concentric rings. The trapezoidal shaped blocks can be cut from a length of board having a constant width and thickness. The modular blocks can be provided as a kit of parts delivered to worksite at an intersection of vehicle roadways where a roundabout is desired. Splitter islands,
(Continued)

sidewalks, and curbing of blocks having appropriate shapes can also be provided.

27 Claims, 17 Drawing Sheets

(51) Int. Cl.

| | |
|---|---|
| ***E01C 5/00*** | (2006.01) |
| ***E01C 5/20*** | (2006.01) |
| ***E01C 5/22*** | (2006.01) |
| ***E01C 11/00*** | (2006.01) |
| ***E01C 11/22*** | (2006.01) |
| ***E01C 19/52*** | (2006.01) |
| ***E01F 9/50*** | (2016.01) |

(52) U.S. Cl.
CPC ..... *E01C 11/00* (2013.01); *E01C 11/221* (2013.01); *E01C 19/52* (2013.01); *E01F 1/00* (2013.01); *E01C 2201/12* (2013.01); *E01C 2201/20* (2013.01); *E01F 9/50* (2016.02)

(56) References Cited

U.S. PATENT DOCUMENTS

| | | | | |
|---|---|---|---|---|
| 5,286,136 | A | 2/1994 | Mandish et al. | |
| 5,490,365 | A * | 2/1996 | Roth | F16B 11/006 405/259.5 |
| 6,718,588 | B1 * | 4/2004 | Frederiksen | B65G 69/30 14/69.5 |
| 6,993,801 | B2 * | 2/2006 | Marko | A63C 19/10 14/69.5 |
| 7,591,605 | B2 * | 9/2009 | Jonasz | E01F 9/529 404/15 |
| 7,594,778 | B2 * | 9/2009 | Baranoff | E01C 9/086 404/73 |
| 8,388,261 | B1 * | 3/2013 | Lane | E01C 9/08 404/25 |
| D722,084 | S * | 2/2015 | Lane | D15/28 |
| 9,908,692 | B2 * | 3/2018 | Corbin | B65D 90/12 |
| 2006/0245828 | A1 * | 11/2006 | Jonasz | E01F 9/529 404/15 |
| 2014/0270938 | A1 * | 9/2014 | Main | E01C 1/02 404/7 |
| 2016/0326873 | A1 * | 11/2016 | Skogseth | E21D 21/008 |

FOREIGN PATENT DOCUMENTS

| | | | |
|---|---|---|---|
| DE | 102004020101 | A1 | 11/2004 |
| DE | 202009002775 | U1 | 7/2009 |
| EP | 1199408 | A1 | 4/2002 |
| GB | 2310235 | A | 8/1997 |
| KR | 101253691 | B1 | 4/2013 |
| NL | 1017945 | C2 | 10/2002 |

OTHER PUBLICATIONS

"Roundabouts", Traffic Calming Australia, (2009), retrieved from http://www.tcaaustralia.com.au/roundabout.html on Aug. 16, 2016.
Traffic Calming Australia catalog, (2009), retrieved from http://www.tcaaustralia.com.au/catalogue.html on Aug. 16, 2016.

* cited by examiner

MODULAR BLOCK SYSTEM FOR ROUNDABOUTS

CROSS REFERENCE TO RELATED APPLICATIONS

This application claims priority under 35 § 119(e) of U.S. Provisional Application No. 62/217,412, filed on Sep. 11, 2015, entitled "Modular Building Blocks for Roundabout", the disclosure of which is hereby incorporated by reference.

STATEMENT REGARDING FEDERALLY SPONSORED RESEARCH OR DEVELOPMENT

The invention was developed with financial support from Contracts No. DTRT57-15-C-10014 and No. DTRT57-16-C-10028 from the Department of Transportation. The U.S. Government has certain rights in the invention.

BACKGROUND

A traffic roundabout (also termed traffic circle or rotary) is a central island located at the intersection of several vehicle roadways around which vehicles entering from the roadways flow in a circular pattern. Roundabouts offer several benefits to traffic flow. Traffic congestion can be reduced compared to all-way-stop-sign and traffic light-controlled intersections. The speed of approaching vehicles can be reduced at stop-controlled intersections, providing gaps for entry of minor-road traffic.

Miniature roundabouts (mini-roundabouts) are characterized by a small diameter central circle with traversable central and splitter islands. Mini-roundabouts can double traffic-handling capacity compared to 4-way stop sign control. They can cost less than larger roundabouts by eliminating land purchase or utility/drainage relocation. Mini-roundabouts can result in greater safety for drivers, pedestrians, and bicyclists. They offer most of the benefits of larger diameter, non-traversable roundabouts with the added advantages of smaller footprint and lower cost, making them attractive improvements for many two-and three-lane intersections.

SUMMARY OF THE INVENTION

A modular block system for roundabouts for vehicular traffic is provided that can be used to form a roundabout of any diameter, including miniature roundabouts. A roundabout employing the modular block system includes a plurality of modular blocks arranged in a generally circular roundabout pattern and affixed to a roadway or ground surface at an intersection of vehicle roadways. A first perimeter portion of the plurality of the blocks is arranged to form segments of a perimeter of the roundabout. A second interior portion of the plurality of the blocks is arranged inwardly from the blocks of the first perimeter portion to form an interior of the roundabout. The roundabout can be traversed by a vehicle, such as cars, trucks, and snowplows, if necessary. A method of installation of a roundabout from modular blocks is also provided.

In some embodiments, modular blocks can be fabricated from a board or sheet that can be cut or trimmed to the desired sizes to fit a particular roundabout size and pattern. In some embodiments, the modular blocks can be molded to a near-final shape, requiring little post-process machining. The modular blocks can be made from a number of suitable materials, including recycled plastic materials. In some embodiments, the material can incorporate crumb rubber from recycled tires.

A roundabout employing the modular blocks can be installed rapidly, in some embodiments, in one or two days. The modular blocks can be prefabricated and shipped as a kit to a roundabout site for installation. Modular blocks can also be used to form other structures associated with a roundabout, such as sidewalks, curbs and splitter islands.

DESCRIPTION OF THE DRAWINGS

The invention will be more fully understood from the following detailed description taken in conjunction with the accompanying drawings in which.

DETAILED DESCRIPTION OF THE INVENTION

This application incorporates by reference the entire disclosure of U.S. Provisional Application No. 62/217,412, filed on Sep. 11, 2015, entitled "Modular Building Blocks for Roundabout."

Figure 1:
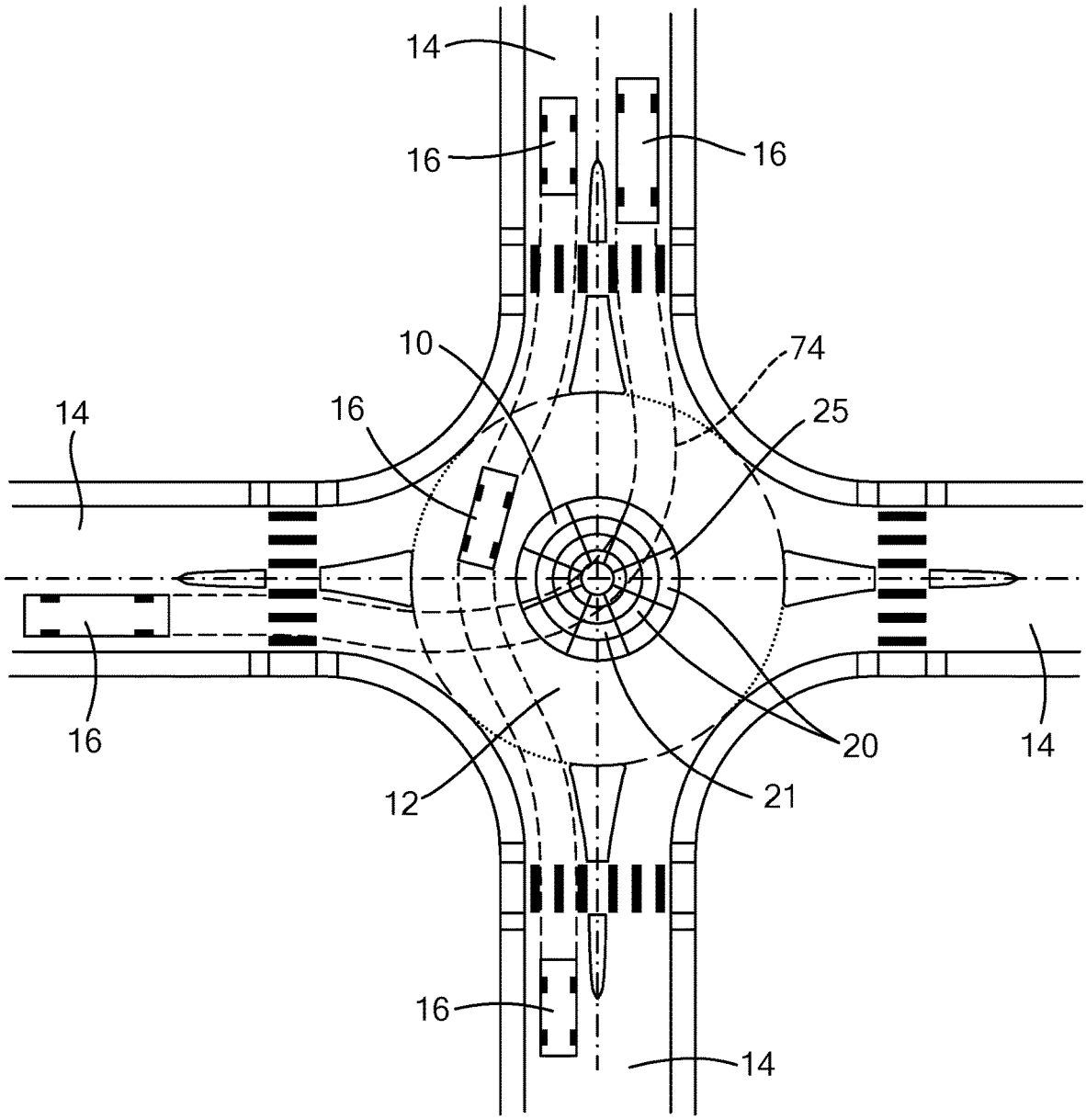
FIG. 1 is a schematic plan view of an embodiment of a roundabout at an intersection of four vehicle roadways according to the present invention.

FIG. 1 illustrates an embodiment a roundabout 10 for vehicular traffic employing a modular block system to form a roundabout of any diameter. The system includes modular blocks 20 that can be arranged in a generally circular roundabout pattern having an interior portion 21 and a perimeter portion 25. The blocks are fastened to a supporting surface at an intersection 12 of three or more entering vehicle roadways 14. Four entering vehicle roadways are typical. Vehicles 16 are directed into a circular flow pattern around the roundabout. A roundabout with modular blocks as described herein can be installed rapidly, in some embodiments within one day or within two days.

Roundabouts can be provided with any desired block pattern. One embodiment of a roundabout 10 is illustrated in FIGS. 2-10. The roundabout is formed from a number of modular blocks 20 arranged in concentric rings 22*a*, 22*b*, 22*c*, 22*d*. (Four rings are shown, but any number can be provided, as determined by the particular roundabout design.) Each of the blocks 20 in the concentric rings has a trapezoidal shape in plan view so that the blocks can be further arranged in wedges 24 extending radially inwardly from a perimeter 26 toward a central region 28 of the roundabout. (Twelve wedges are shown, but any number can be provided, as determined by the particular roundabout design.) In particular, each block 20 is in the shape of an isosceles trapezoid having two parallel sides or bases 32, 34, the outer base 32 being longer than the inner base 34, and two non-parallel lateral sides or legs 36, each leg having the same length. See FIGS. 4A-4D. The outermost ring 22*a* of blocks forms the perimeter portion 25 defining a perimeter 26 of the roundabout. The inner rings 22*b*, 22*c*, and 22*d* form the interior portion of the roundabout.

In some embodiments, each of the modular blocks can be formed from one or more boards 42 that can be cut or trimmed to provide the desired shapes for each roundabout. The boards can be provided as a stock material in any suitable length with a constant thickness t and constant width w. See FIG. 5. In some embodiments, to form trapezoidal blocks 44, cuts 46 are made at an angle $\alpha$ in alternating directions at desired locations along the length of the board. Cutting can be done by any suitable cutting technique, such as with a carbide-coated circular saw, water jet cutting, laser cutting, and the like. In some embodiments, the entire length of the board can be used except for the ends, minimizing the amount of scrap material. See FIG. 6. After the cuts are made, alternate trapezoids 44' are flipped over, so that all of the blocks 20 can have a similar orientation. See FIG. 7. Any suitable arrangement for cutting the blocks can be used. In some embodiments, cuts can be made by alternating the angle of the saw blade along the length of the board. In some embodiments, two saws each set for a different angle can be provided as the board is moved along after each cut.

Figure 8:
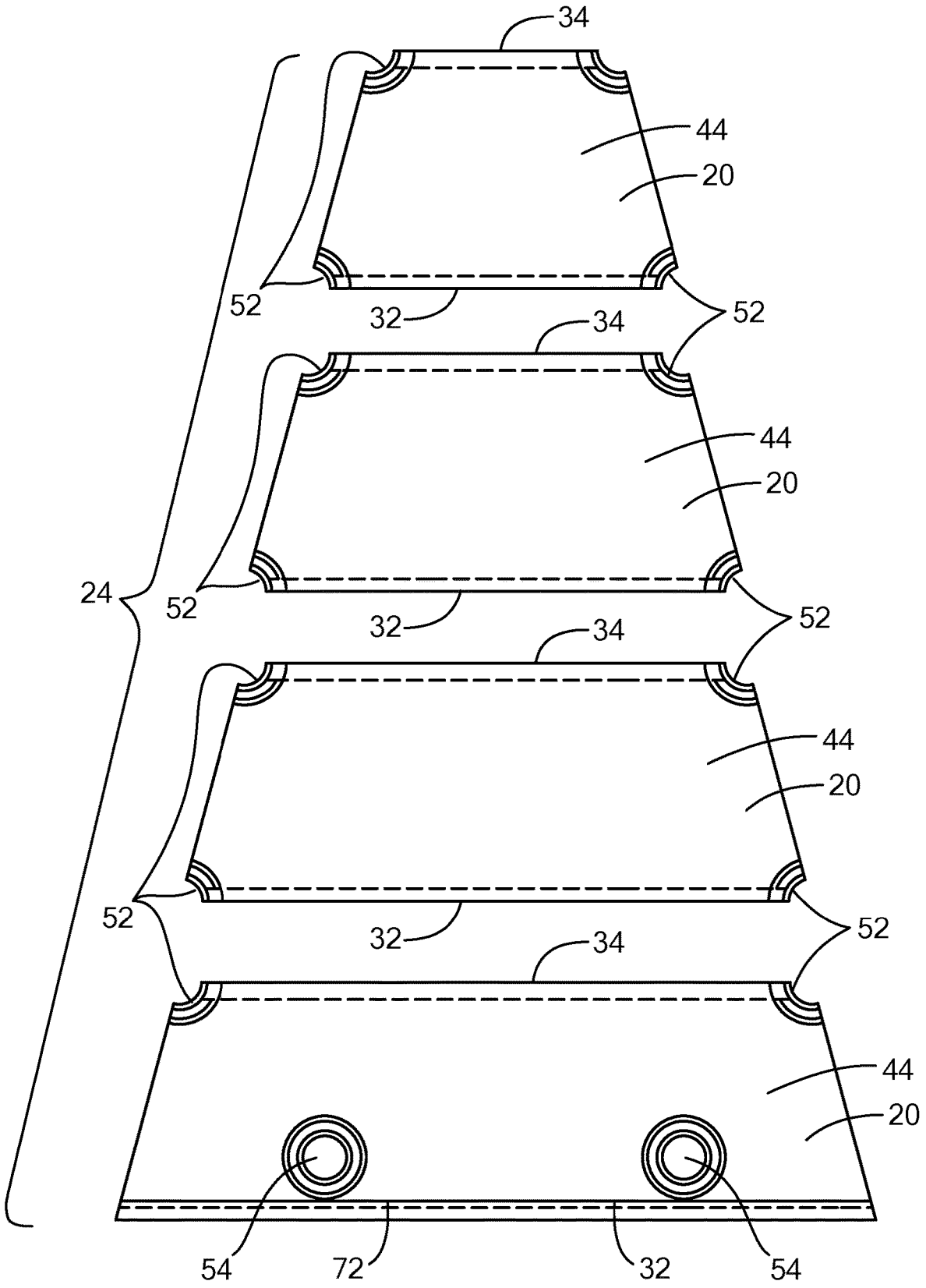
FIG. 8 is an exploded plan view of four trapezoidal shaped modular blocks arranged to form a wedge.
Figure 9:
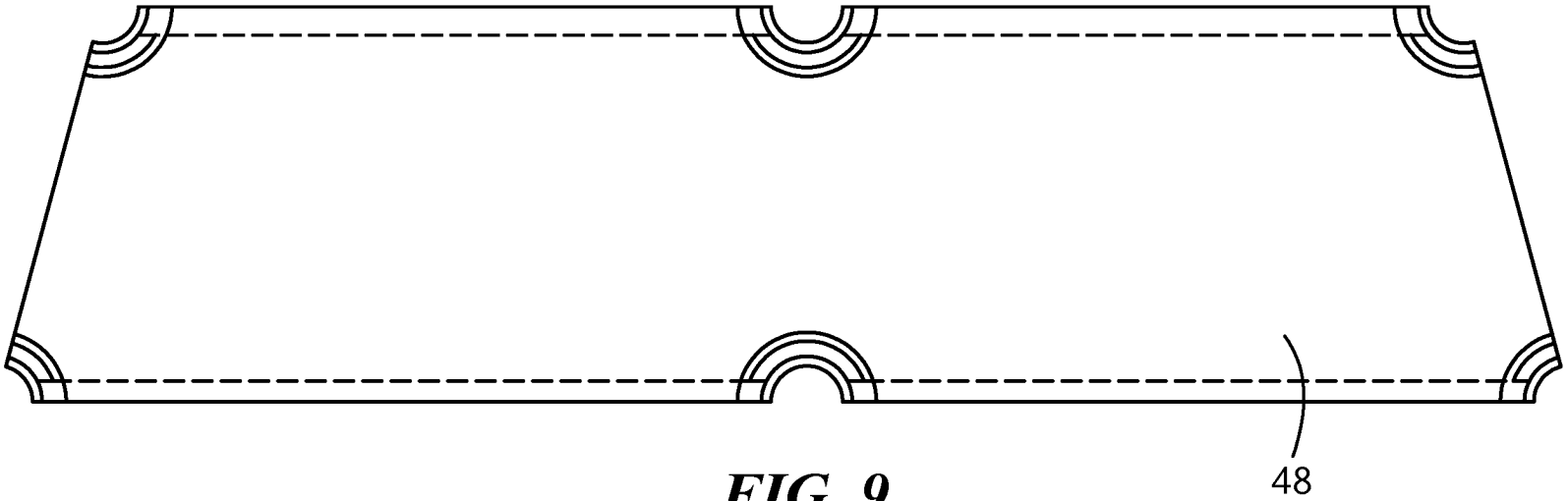
FIG. 9 is a plan view of a modular block for a central region of the roundabout of FIG. 2.
Figure 10:
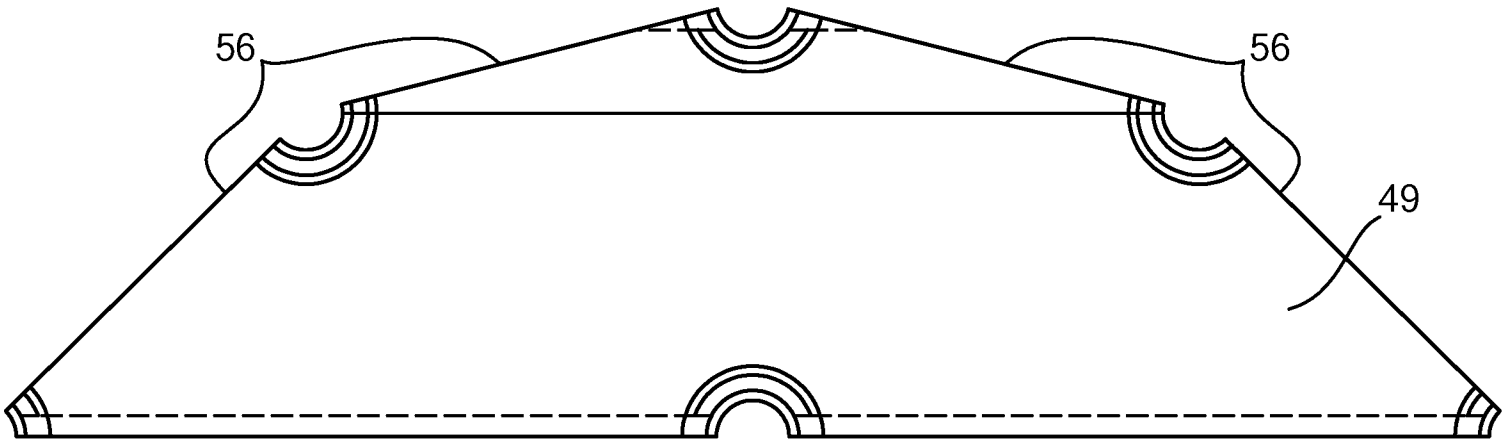
FIG. 10 is a plan view of a further modular block for the central region of the roundabout of FIG. 2.

The angular cuts can be made at locations along the length of the board so that the modular blocks 20 can be arranged in concentric rings to form wedges, indicated in FIG. 8. More particularly, the blocks for a single ring are all cut so that the outer bases 32 have the same lengths and the inner bases 34 have the same length. The blocks in the adjacent rings are cut so that the length of the outer base 32 is the same or substantially the same as the length of the adjacent inner base 34 of the abutting block in the abutting ring. There can be some difference in adjacent lengths to allow for tolerances of the cuts and/or to allow water to drain from surfaces.

Figure 2:
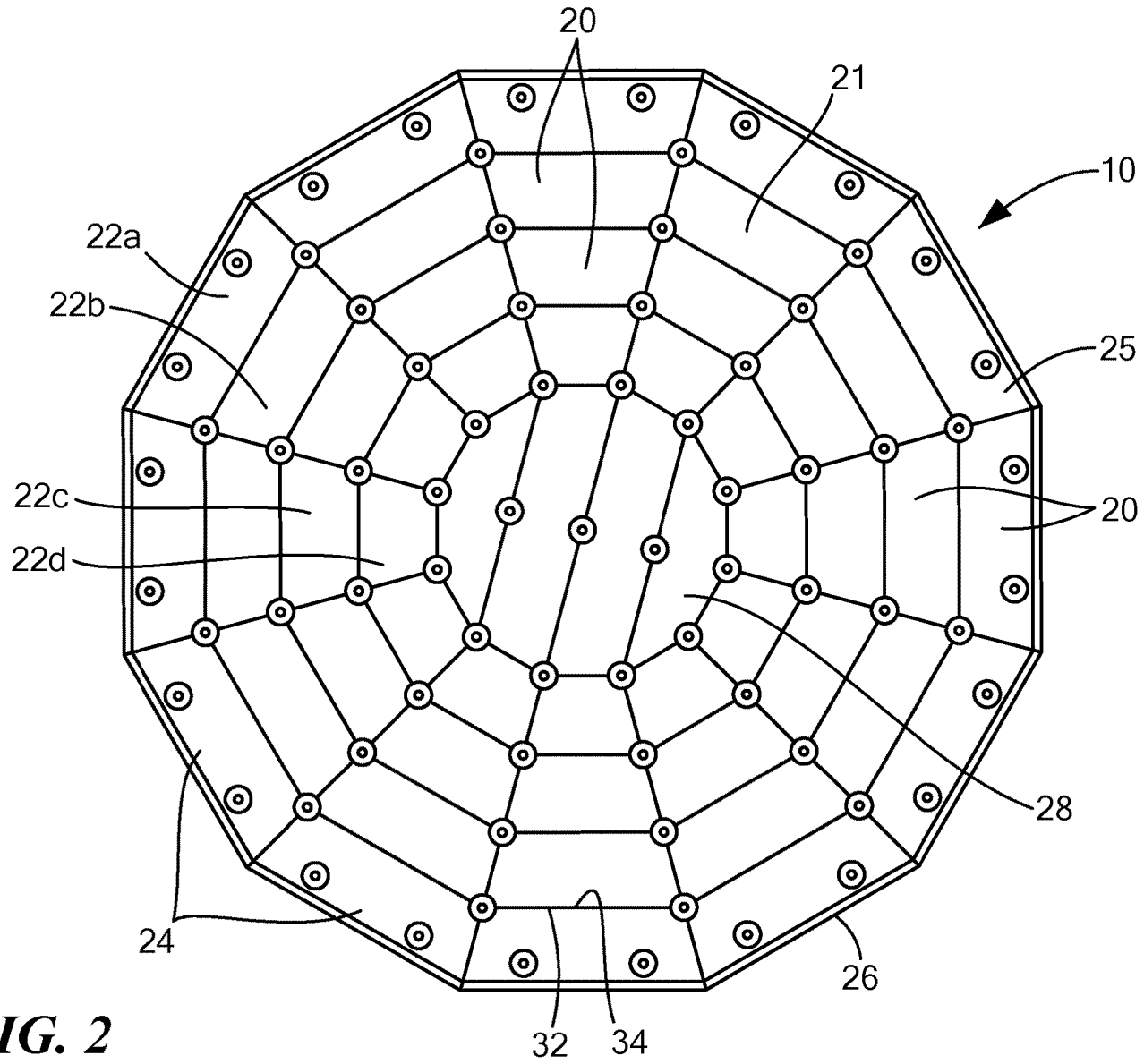
FIG. 2 is a plan view of an embodiment of a roundabout from a plurality of modular blocks.
Figure 3:
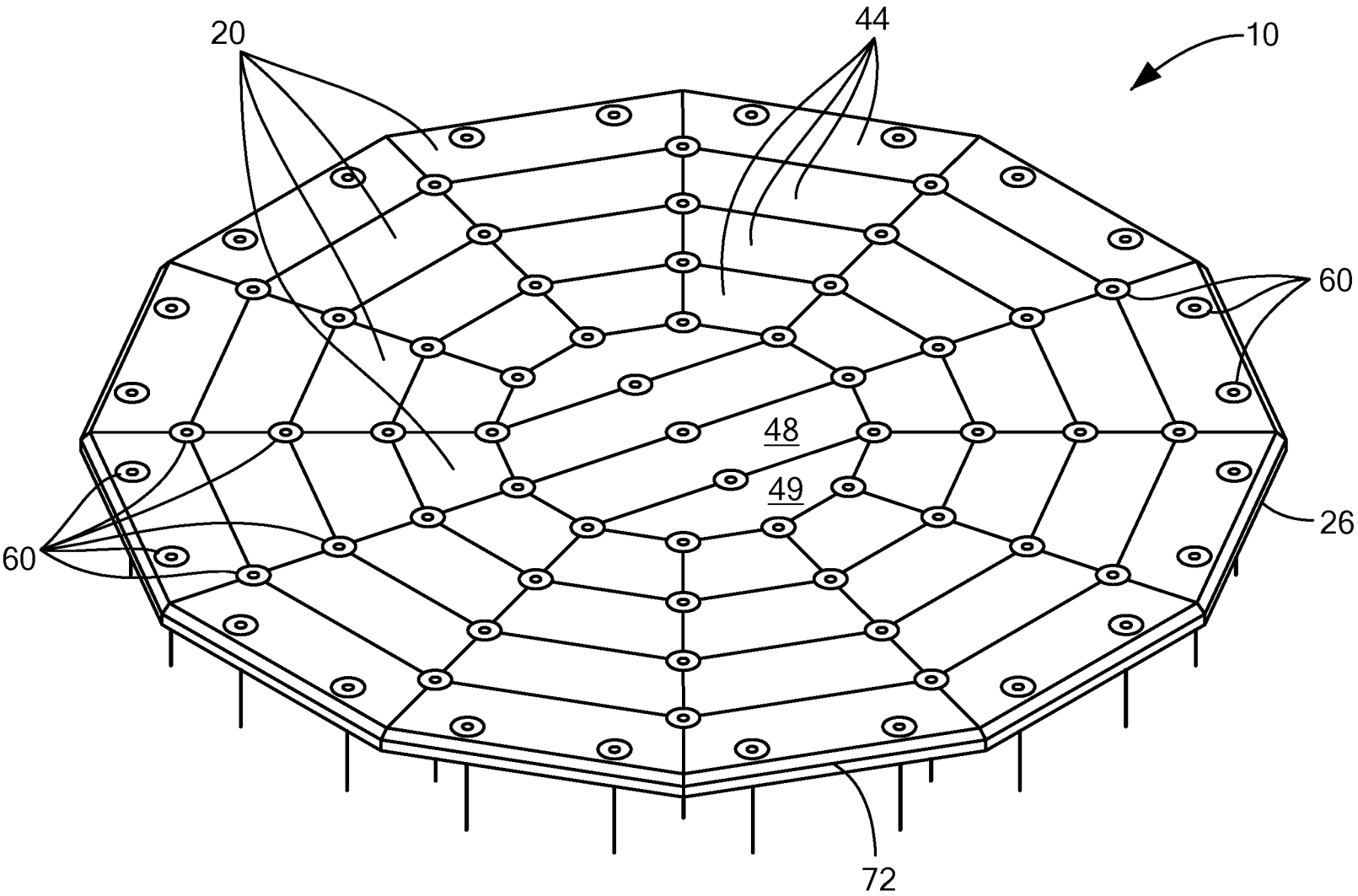
FIG. 3 is an isometric view of the roundabout of FIG. 2, also illustrating ground anchors extending below the modular blocks.
Figure 4A:
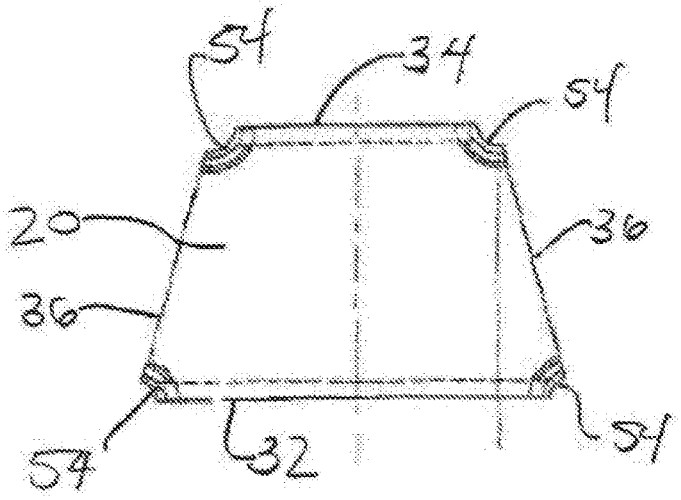
FIG. 4A is a plan view of a single trapezoidal shaped modular block of the roundabout of FIG. 2.
Figure 4C:
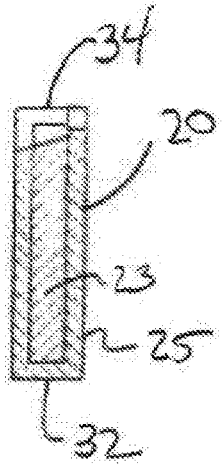
FIG. 4C is a cross-sectional view of the modular block of FIG. 4A.
Figure 4D:
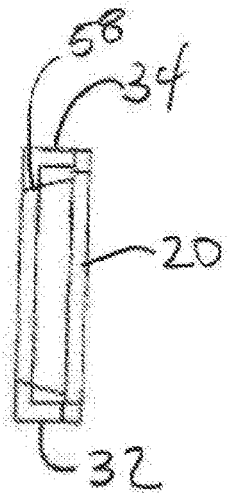
FIG. 4D is a side view of the modular block of FIG. 4A.
Figure 4B:
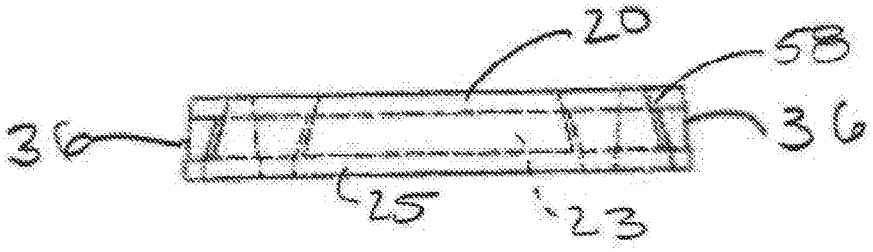
FIG. 4B is an end view of the modular block of FIG. 4A.
Figure 5:
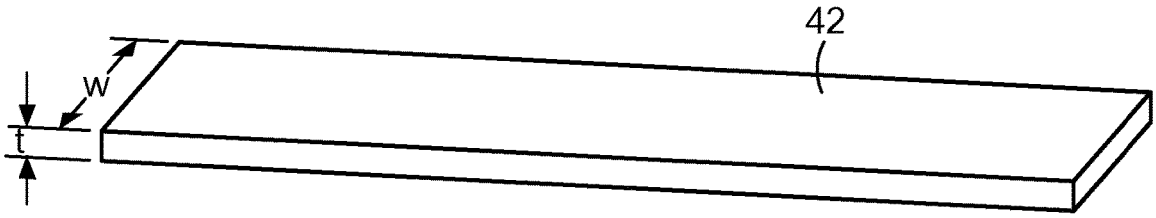
FIG. 5 is an isometric view of a board for fabricating trapezoidal shaped modular blocks.
Figure 6:
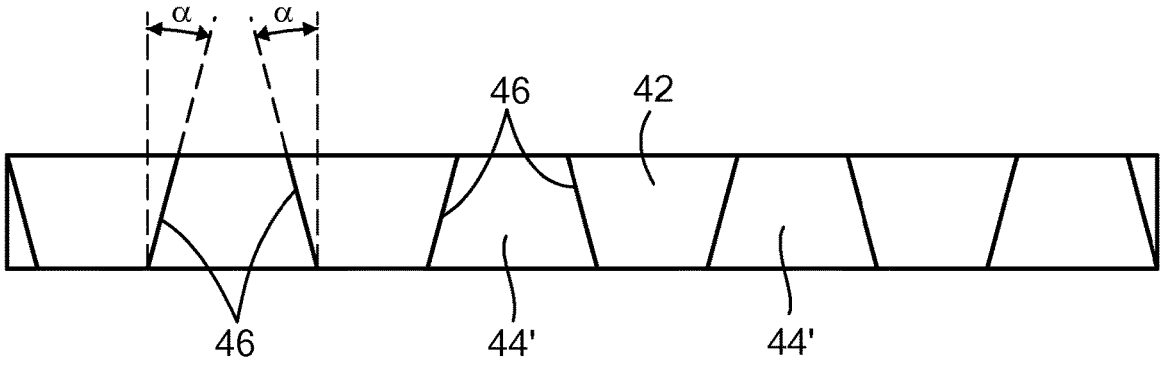
FIG. 6 is a plan view of the board of FIG. 5 illustrating angular cuts to form trapezoidal shaped modular blocks.
Figure 7:
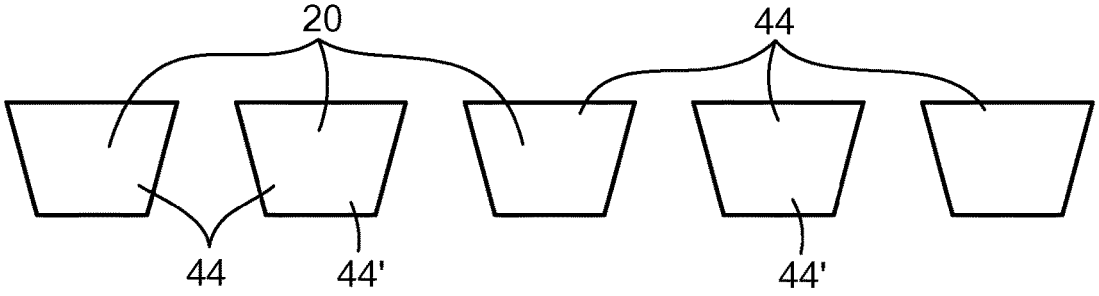
FIG. 7 is a plan view of several trapezoidal shaped modular blocks formed from the board of FIG. 5.

For example, the roundabout pattern shown in FIGS. 2 and 3 has four concentric rings (22*a*, 22*b*, 22*d*, 22*d*), and the blocks in each ring are arranged in twelve wedges 24, each wedge occupying about 30° of the circle. The angle a for each block is about 15°. Each block 20 has the same thickness t and width w. The roundabout can be made with a larger diameter by adding one or more concentric rings 22 to the perimeter or with a smaller diameter by using fewer rings. Also, different roundabout diameters can be achieved by selecting an appropriate width w for the blocks during the design phase. In some embodiments, some rings can have a different width than other rings. It some embodiments, different roundabout patterns can be provided with trapezoidal blocks that are not all cut at the same angle $\alpha$; that is, some trapezoidal blocks can be cut at different angles.

Boards 42 can be manufactured from any suitable material in any suitable manner, such as by an extrusion process, a pultrusion process, or by molding. Board stock from suitable materials is also commercially available in a variety of sizes and lengths and can be purchased.

In other embodiments, the modular blocks 20 can be produced by a molding process, such as compression molding. Compression molding uses high pressure to force a thermoplastic material into a tool. This process is generally suitable for large complex parts and extremely high viscosity resins. For a roundabout, a mold for each size and shape of block can be provided.

In some embodiments, the blocks can be made from a single material uniformly distributed throughout the volume of the block. In some embodiments, the blocks can be made with an interior volume 23 differing from an outer layer 25 (indicated schematically in FIGS. 4A-4D and other figures). For example, the interior volume can have a different density than the outer layer, or the interior volume can be of one material and the outer layer can be made of a different material. In some embodiments, the interior volume can be hollow.

After the blocks 20 have been formed with the desired sizes and shapes, openings can be formed in each block, for example by drilling or otherwise machining, at appropriate locations to receive fasteners 60, such as ground anchors, for fastening to the supporting surface. In the embodiment illustrated in FIGS. 2 and 3, openings 52 are formed at the corners of abutting blocks. In some embodiments, openings at corners and along edges can be made on a milling machine. In embodiments in which blocks are molded, openings can be formed as part of the molding process, eliminating or minimizing the need for further machining, or openings can be formed after molding, for example, by drilling or otherwise machining. While round or circular openings are shown, the openings can have other shapes. For example, square, rectangular, or asymmetrical openings can help prevent twisting rotations of adjacent modules. Additional openings 54 are formed in intermediate locations of the outermost ring of blocks. Fasteners at openings 52 at the corners of abutting blocks allow some movement due to thermal expansion and contraction. Fasteners along the perimeter 26 of the outermost ring 22*a* allow these blocks to be more firmly fixed to their locations on the ground. Locations of the openings can be selected as desired for a particular roundabout size and pattern. In some embodiments, the openings can include a tapered or conical section 58 with an interior lip (see FIGS. 4B, 4D) to receive plugs for use with ground anchors, described further below.

As shown in FIGS. 2, 3, 9 and 10, the central region 28 of the roundabout 20 is filled with several modular blocks 48, 49 cut to fit in a parallel alignment. Each block can have the same width w and thickness t as the trapezoidal blocks 44 in the concentric rings. The two blocks 48 in a middle area are trapezoidal in plan. The two blocks 49, arranged on opposite sides of the middle blocks, are further cut to have segmented sides 56 to abut against inner bases of the innermost ring 22*d* of blocks.

Figure 11:
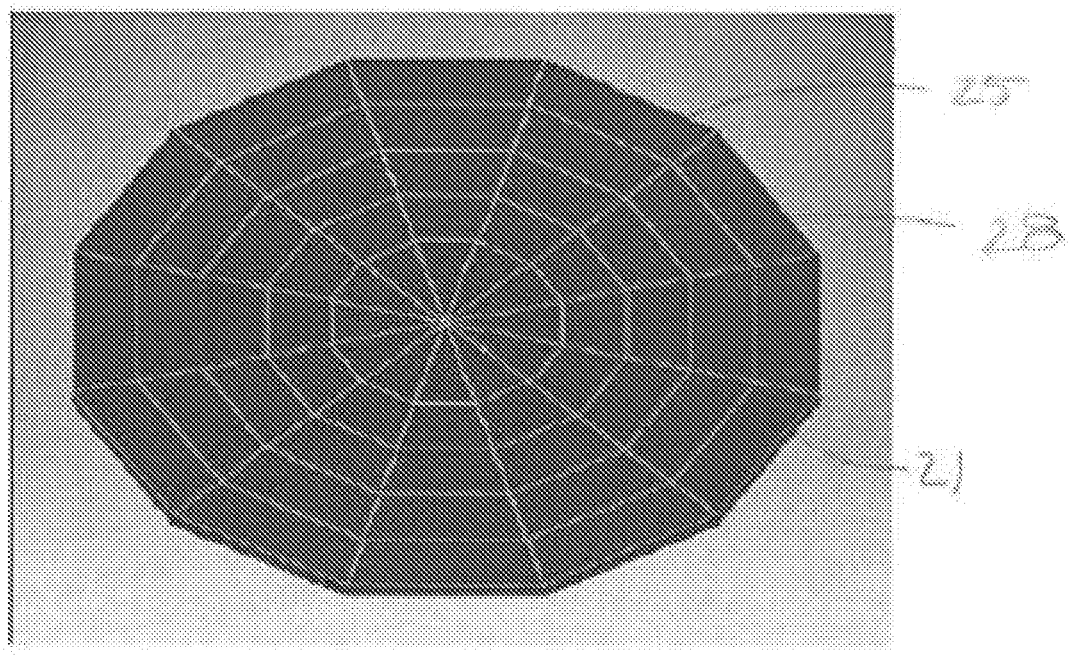
FIG. 11 is a plan view of a further embodiment of a roundabout from a plurality of modular blocks.
Figure 12:
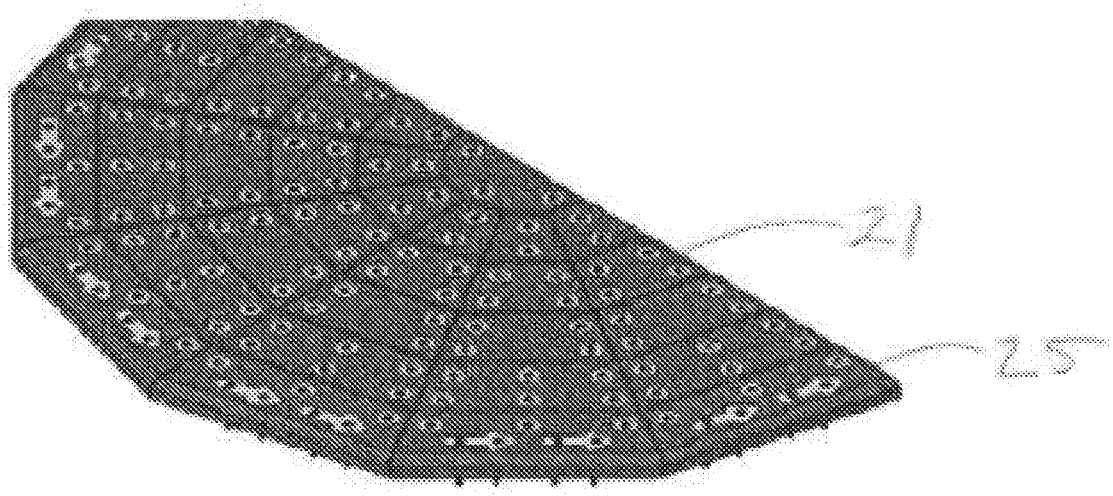
FIG. 12 is a partial isometric view of a still further embodiment of a roundabout from a plurality of modular blocks.

In another embodiment, the central region 28 can be filled with modular blocks having a triangular shape in plan view to continue the wedges toward a midpoint of the roundabout, as shown in FIG. 11. In further embodiments, the central region can be filled with a single, generally circular block or two half-circular blocks. See FIG. 12. FIG. 12 also illustrates fasteners at intermediate locations within each of the blocks, rather than at corners of the blocks. In still further embodiments, the central region can be free of modular blocks and can be filled with other materials, for example, plantings, gravel, or a paving material such as asphalt or concrete. Signage can also be located in the central region or at other suitable locations on the roundabout. In some embodiments, one or more curbing blocks can be used to demarcate in inner diameter of the roundabout, circumscribing the central region to be left free of blocks. The curbing blocks can rise about the surface of the blocks, creating a physical barrier to a vehicle's ability to travel further toward the roundabout center.

The outermost ring of modular blocks can have straight edges, as shown in FIGS. 2, 3, 11, and 12, such that the perimeter 26 of the roundabout is a series of straight segments approximating a circle. Alternatively, the outermost edge of each block can be cut or otherwise formed to have a circular arc, such that the roundabout has a circular or substantially circular perimeter. See FIGS. 20 and 21, described further below. The outermost edges of the perimeter 26 can be beveled or chamfered or cut to provide a slope 72 to form a transition in case a vehicle drives over the roundabout, either accidentally or intentionally. For example, with some smaller diameter roundabouts, a truck with a large turning radius may need to drive partially or fully over the roundabout (indicated by dotted lines 74 in FIG. 1). Also, snowplows may ride up onto the roundabout when covered with snow.

The roundabout 10 can be placed on top of any suitable supporting surface. In some embodiments, the roundabout can be placed over an existing road surface, for example, of asphalt or concrete. In some embodiments, the roundabout can be placed on a gravel bed or compacted soil. The blocks can be attached to the supporting surface in any suitable manner, for example, using fasteners, adhesives or a combination thereof. The fasteners and adhesives can be selected to suit the type of supporting surface and other site conditions. For example, in some embodiments, particularly when the roundabout is placed on an existing road surface, ground anchors can be provided to attach the blocks to the supporting surface. Depth of anchor penetration and number and locations of anchors can be determined depending on the size of the roundabout, road surface conditions, soil and weather conditions, and the like.

In some embodiments, the blocks 20 can be prefabricated and shipped to a work site as a kit of parts, including all the blocks formed in the appropriate shapes. Appropriate attachment hardware and/or adhesive materials to fasten the roundabout to the supporting surface can also be included.

Figure 13:
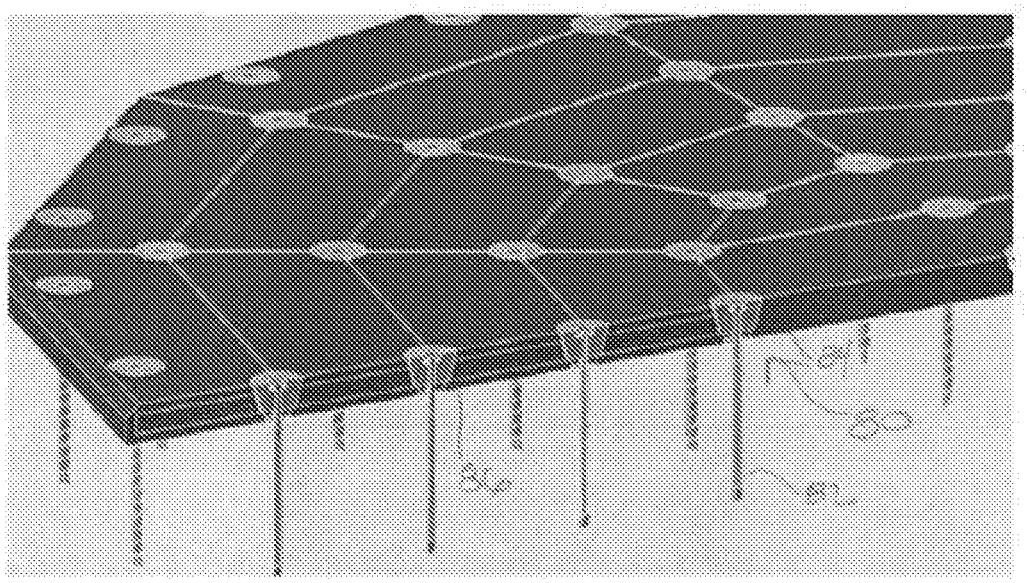
FIG. 13 is a partial isometric view illustrating an embodiment of a ground anchor for use with the roundabout of FIG. 2.
Figure 14:
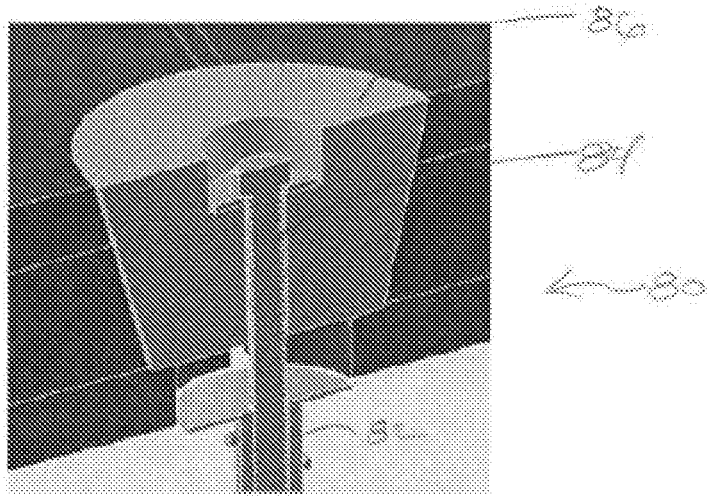
FIG. 14 is a partial view of a ground anchor of FIG. 13.
Figure 15:
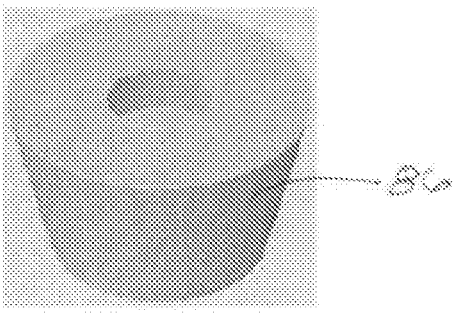
FIG. 15 is an isometric view of a plug for use with the ground anchor of FIG. 13.
Figure 16:
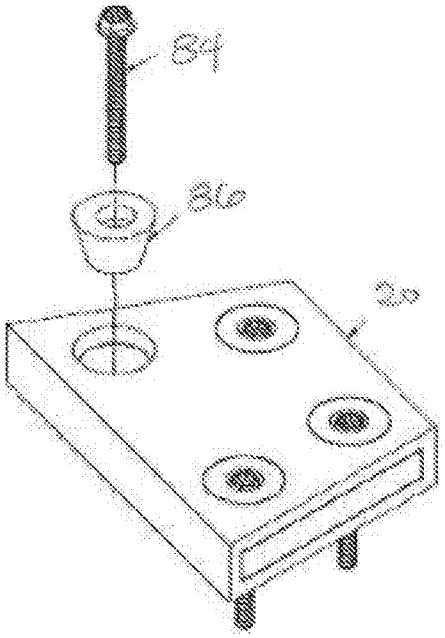
FIG. 16 is an isometric view of a further embodiment of a modular block using the ground anchor of FIG. 13.

One embodiment of a ground anchor 80 suitable for attaching modular blocks to an existing roadway is illustrated in FIGS. 13-15. The ground anchor includes a hollow, internally threaded insert 82 for the ground and an externally threaded fastener bolt 84. Grout, such as a quick-set epoxy, is injected into the hole in the ground, through the opening in the block or between blocks, and the hollow insert is placed into the grout in the hole. A plug 86 is placed in the hole in the block or between blocks, and the fastener bolt is placed through each plug and threaded into the hollow threaded insert. The plug can have a tapered truncated conical or pyramidal shape. The plug serves as a washer and allows the blocks to be tightly clamped to the ground in a manner that permits a loose tolerance in drilling the ground hole and positioning the hollow insert and fastener bolts. The grout is allowed to cure for a suitable time before the bolt is finally tightened. Suitable cure times can range from about 5 minutes to about 2 hours or longer, depending on the grout. The bolt can later be removed to facilitate removal and replacement of individual blocks without disturbing adjacent blocks if necessary. One suitable ground anchor is commercially available from Asphalt Anchor Group, of New Jersey. Other mechanical and/or adhesive fasteners can be used if desired, depending on the application and the nature of the supporting surface.

Embodiments of a roundabout from modular blocks as described herein can be installed rapidly. One embodiment of an installation procedure is as follows: The pattern for arranging the blocks is laid out on the ground. The blocks are then laid out on the ground according to the pattern. Expansion gap shims can be placed between adjacent blocks. Holes are drilled into the ground through the openings in the blocks. The holes in the ground are filled with an appropriate grout, such as a quick set epoxy. A ground anchor, such as the threaded hollow insert and fastener bolt, along with the plug described above, is inserted. The epoxy or other adhesive material is allowed to set. The fastener bolts are torqued to the appropriate specification. The shims are removed. In some embodiments, the gaps between blocks can be filled with a material such as sand or mastic. In some embodiments, the gaps can be left unfilled.

Figure 17:
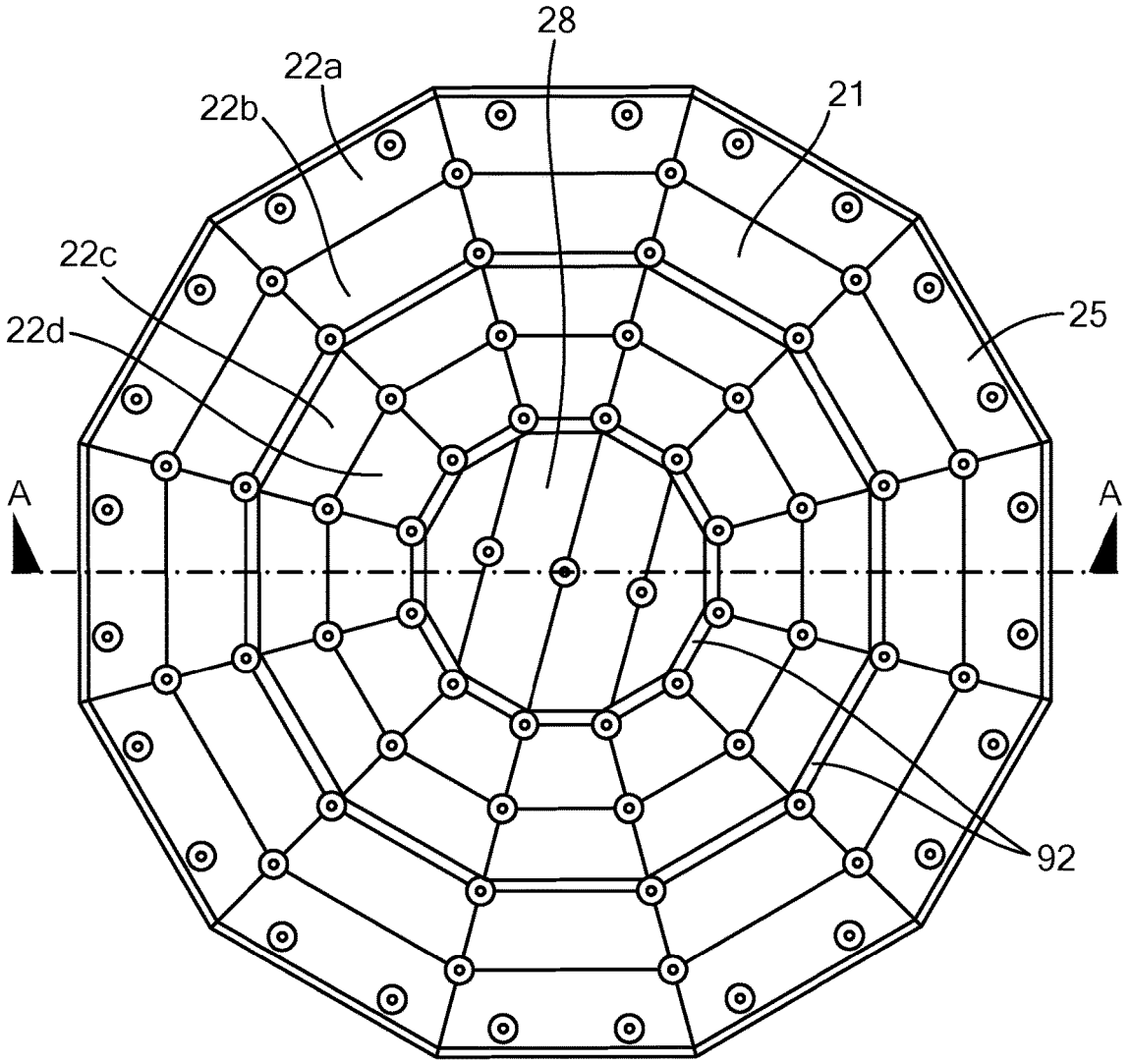
FIG. 17 is a plan view of a still further embodiment of a roundabout from a plurality of modular blocks having varying thicknesses.
Figure 18:
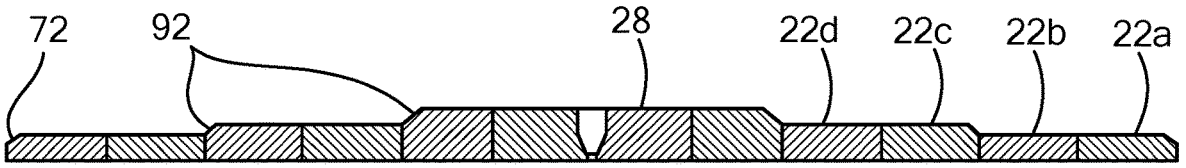
FIG. 18 is a cross-sectional view of the roundabout of FIG. 17.
Figure 19:
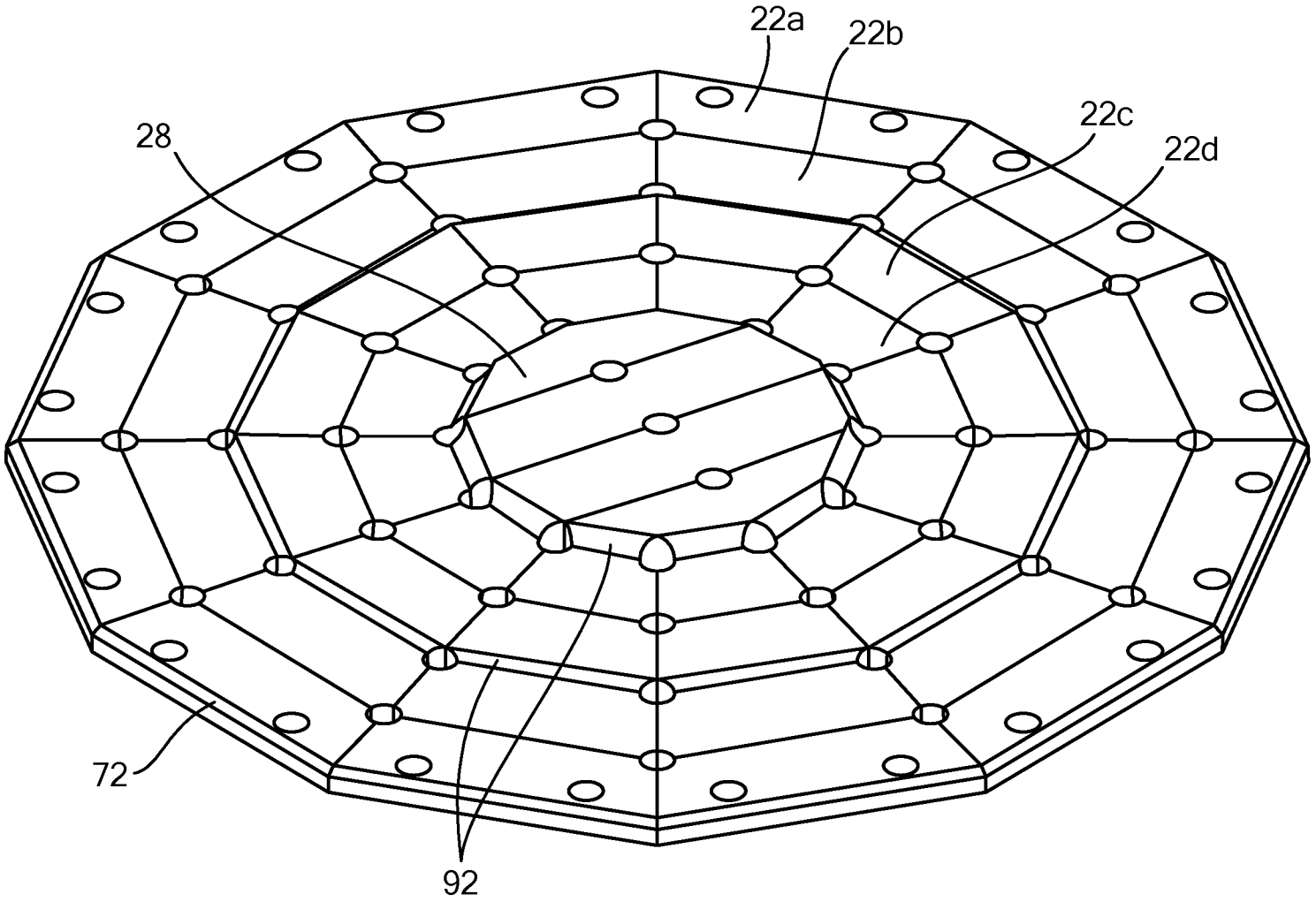
FIG. 19 is an isometric view of the roundabout of FIG. 17.

In some embodiments, the blocks can be formed with different thicknesses, for example, to provide a crown to the roundabout. Referring to FIGS. 17-19, blocks 20 in the two outermost rings 22*a*, 22*b* have the smallest thickness. Blocks in the next two innermost rings 22*c*, 22*d* have a greater thickness. Blocks in the central region 28 have the greatest thickness. Edges of the blocks that form steps where the thickness increases relative to adjacent blocks can be provided with a chamfer or slope 92 to ease the transition to the greater thickness. In some embodiments, the supporting surface includes a crown, so the provision of a crown by formation of the blocks may not be necessary. In some embodiments, the ground surface can be prepared with a crown prior to laying out the blocks.

The roundabout can be formed with other block patterns and block shapes. For example, in some embodiments, hexagonal blocks can be arranged in a honeycomb pattern. In some embodiments, a single roundabout can have a different number of wedge segments at different radii. For example, inner concentric rings can have a smaller number of wedges (for example, 12 wedges) and outer concentric rings (having larger diameters) can have a larger number of wedges (for example 24 wedges). In some embodiments, blocks having shapes other than trapezoidal can be employed, for example, in transitions between wedges of different shapes and/or sizes. In any embodiment, the perimeter portion can be trimmed to or formed with a circular shape such that the roundabout has a constant or substantially constant radius if desired.

Figure 20:
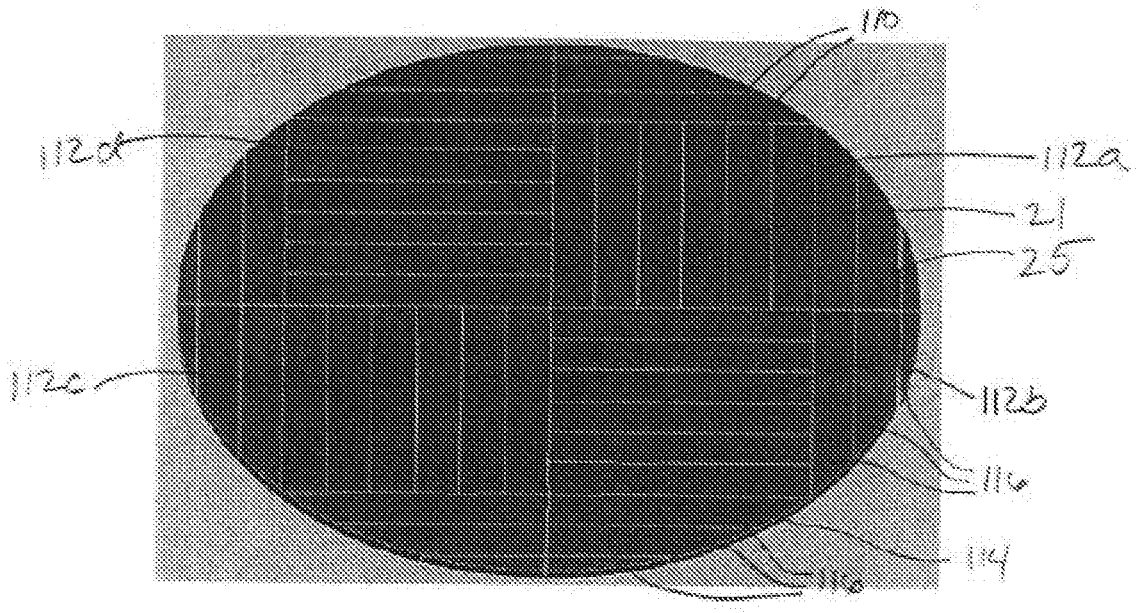
FIG. 20 is a plan view of a still further embodiment of a roundabout from a plurality of modular blocks.

In further embodiments, a roundabout is provided from blocks formed with a generally rectangular shape 110 in plan view. In the embodiment of FIG. 20, rectangular blocks are arranged in four quadrants 112*a*, 112*b*, 112*c*, 112*d*. Blocks in diagonally opposite quadrants, 112*a* and 112*c*, 112*b* and 112*d*, are oriented with their lengths extending in the same direction. A perimeter portion 114 of the roundabout is formed from rectangular blocks 116 that are cut or trimmed to provide a circular perimeter. The edge of the perimeter can be chamfered or sloped to ease the transition of a vehicle onto the roundabout if desired, as described above.

Figure 21:
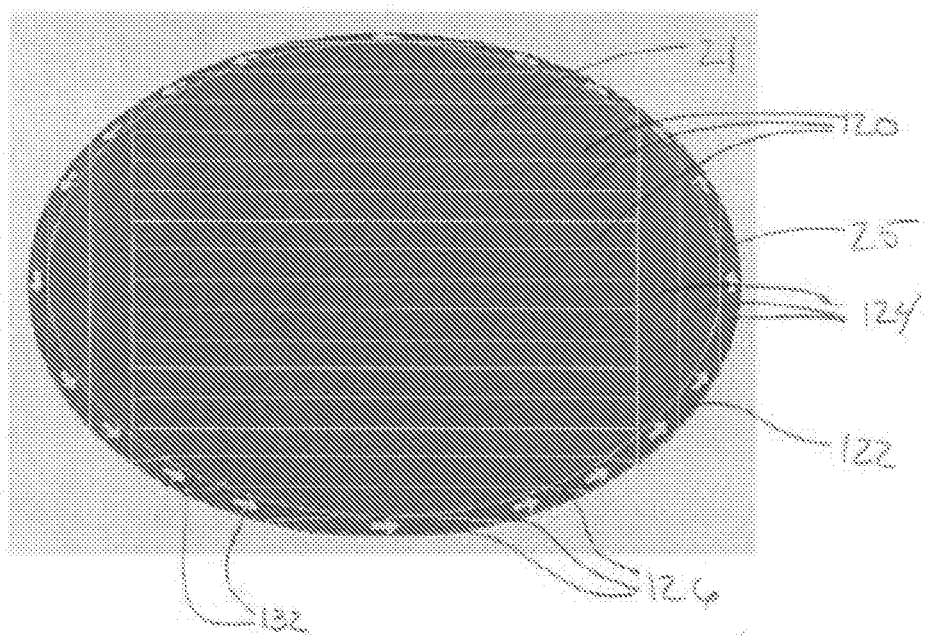
FIG. 21 is a plan view of a still further embodiment of a roundabout from a plurality of modular blocks.
Figure 23:
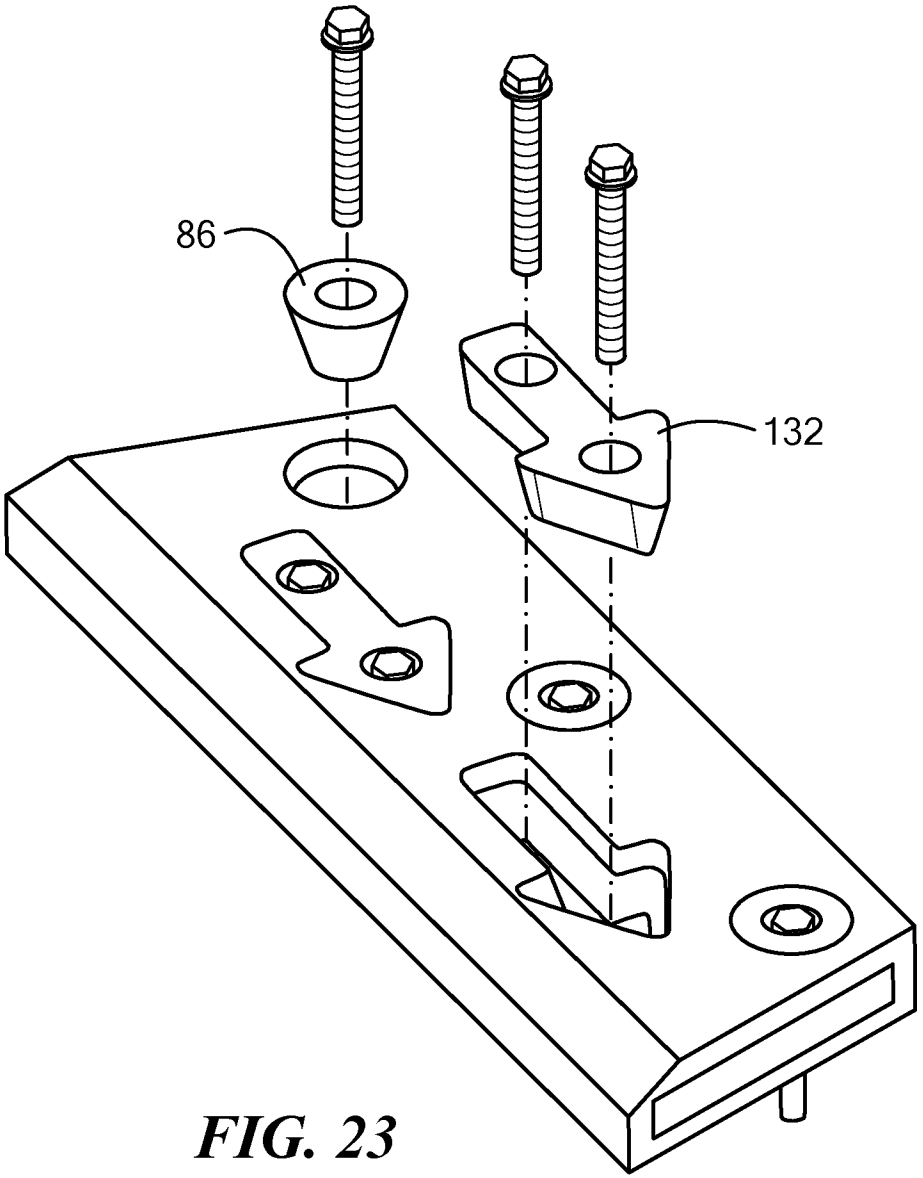
FIG. 23 is an isometric view of a further embodiment of a modular block with the plugs of FIG. 15 and FIG. 22.
Figure 22:
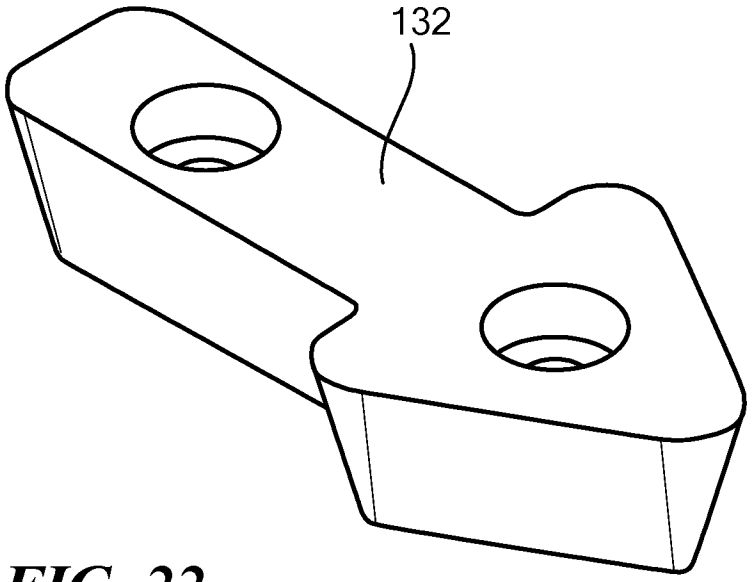
FIG. 22 is an isometric view of a further embodiment of a plug.

In the embodiment of FIG. 21, a roundabout is provided with blocks formed with a longer generally rectangular shape 120 in plan view and disposed in a parallel arrangement. A perimeter portion 122 is provided by three rows of orthogonal blocks 124 on opposite sides of the array along with three rows of parallel blocks 126 at opposite ends of the arrangement. The rectangular blocks of the perimeter portion are cut or trimmed to provide a circular perimeter. The edge of the perimeter can be chamfered or sloped to ease the transition of a vehicle onto the roundabout if desired, as described above. In the embodiment illustrated, plugs 132 for use with the ground anchors are arrow-shaped and oriented to direct traffic flow in a counterclockwise direction around the roundabout. See also FIGS. 22 and 23. It will be appreciated that arrow-shaped plugs can be oriented in a clockwise direction in countries where the traffic flow is clockwise.

Figure 24:
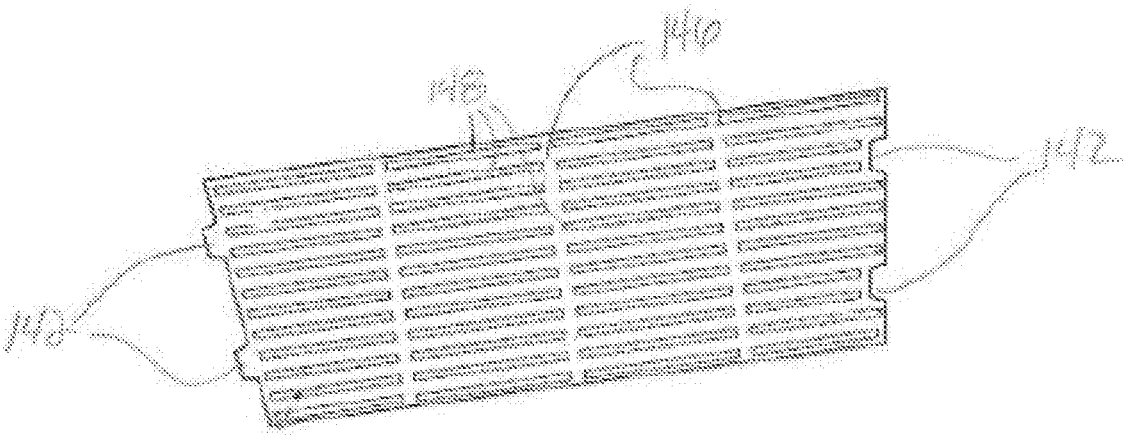
FIG. 24 is a plan view of a further embodiment of a modular block with an interlocking edge detail for a roundabout.
Figure 25:
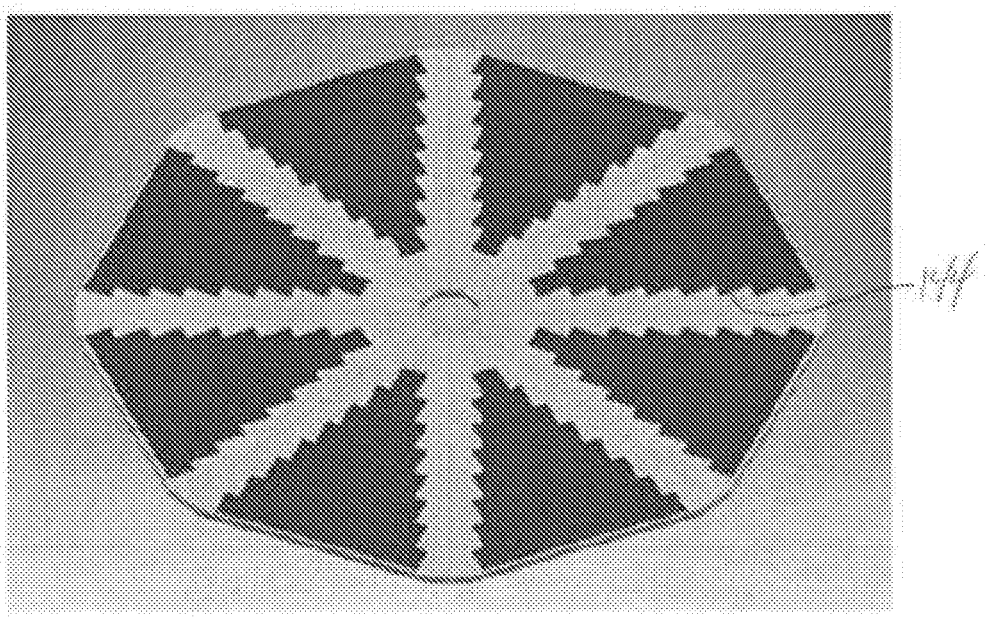
FIG. 25 is an isometric view of a still further embodiment of a roundabout from a plurality of modular blocks with contrasting colors to facilitate visibility.
Figure 26:
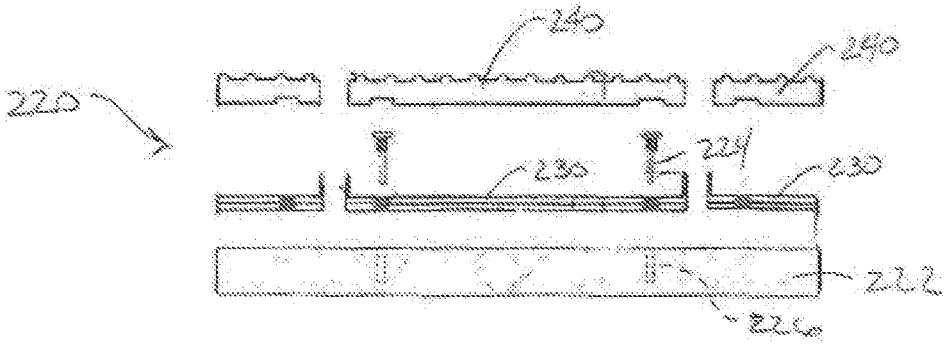
FIG. 26 is an exploded view of a still further embodiment of modular blocks for a roundabout.

In some embodiments, interlocking edge details, such as jigsaw puzzle edges or dovetail features, can be provided along edges of abutting modular blocks for added stability. An interlocking edge detail 142 can be provided along one or more of the parallel and angled sides of the blocks as they are being cut to shape for an individual roundabout geometry. An example of an interlocking edge detail is shown in FIG. 24. Cutting an interlocking edge detail can be done in any suitable manner, such as with a carbide-coated circular saw, water jet cutting, laser cutting, and the like. In the embodiment of FIG. 25, blocks with barb-shaped edges 144 are provided that extend radially from the perimeter to a central region to provide interlocking. In some embodiments, a portion of the modular blocks in a roundabout can be shaped to allow access to features such as manhole covers. In this case, the blocks can be affixed to the ground surface with removable fasteners.

In some embodiments, plugs used with ground anchors can be made with a contrasting color or a reflective material to enhance visibility, particularly at night. In some embodiments, markers such as solar or LED markers can be embedded into or affixed onto the blocks. In some embodiments, drainage radially outwardly towards designated areas can be controlled by one or more surface channels 146 (FIG. 24), spacing between modular blocks, and/or underflow channels. In some embodiments, the surface of the modular blocks can be textured, for example, with strips 148, to provide added traction and/or an audible notification to a driver if a vehicle traverses the roundabout. In some embodiments, the top surface of the plugs can be raised about the surface of the modular blocks.

In some embodiments, the roundabout can have a diameter ranging from about 5 feet to about 120 feet, although larger or smaller diameters can be provided if desired. In some embodiments, the thickness of the modular blocks can range from about 2 inches to about 8 inches, although greater or lesser thicknesses can be provided if desired. In some embodiments, the width of trapezoidal modular blocks in a radial direction can range from about 6 inches to about 36 inches, although greater or lesser widths can be provided. In some embodiments, the roundabout can withstand occasional truck loads of at least about 22,000 lb/axle.

In yet further embodiments, a modular building block system comprises a two-piece assembly 220 of blocks. The assembly includes a flat pan 230 and an associated overlying surface layer block 240. Both the pan and the surface layer block can have any suitable shape, such as trapezoidal or rectangular, as described above. The pan is placed first directly onto the prepared ground 222. In some embodiments, a bonding/waterproofing agent such as tar or other adhesive can be applied to the pan undersurface and the road. The pan can be held securely in place by anchors 224 passing through precut holes 226 in the pan into the ground, as described above.

The surface layer block 240 has the same physical plan form as the pan 230. It can be designed to provide vehicles traversing the central roundabout circle with added traction and/or an audible indication that a vehicle has departed the primary travel lane, such as a rumble strip, as described above. It can also include features such as narrow channels to direct water runoff outwardly from the center of the roundabout to its perimeter, also as described above.

Figure 27:
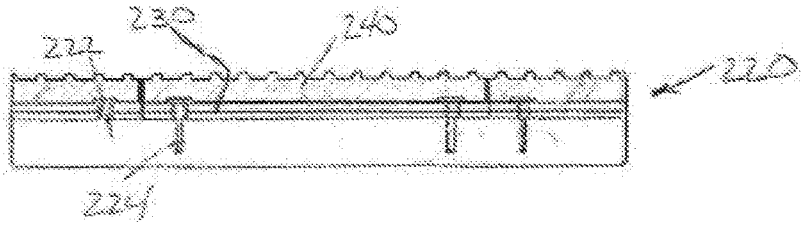
FIG. 27 is a side view of the modular blocks of FIG. 26.

After all the pans 230 have been placed and attached to the ground, the surface layer blocks 240 can be affixed, as by bonding with a suitable adhesive, on top of their matching pans. This forms a two-layer sandwich, covering the heads of the ground anchors and locking them in place. See FIG. 27. The surface layers blocks can be made using a different manufacturing process and material than the pan, if desired. For example, the major loads seen by the pan are vertical compression from axle loads, and shear from traffic acceleration and deceleration when on the surface. The surface layer blocks, in addition to providing an audible indication that a vehicle has departed the primary road surface and is now physically on the roundabout, experience similar compressive loads as the pans, but in addition are directly exposed to UV from sunlight, road salt, vehicle fluids, and abrasion from tires and snow plows. In some embodiments, a different material can be selected for the pan and the surface layer to address these differing conditions.

Figure 28:
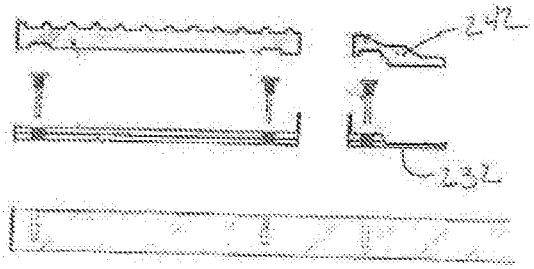
FIG. 28 is an exploded view of a transition strip for use with the modular blocks of FIG. 26.
Figure 29:
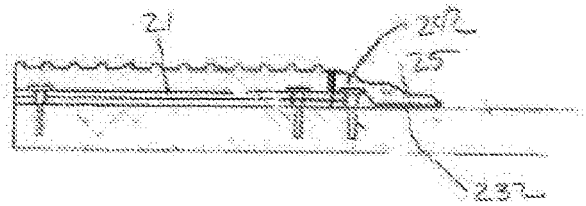
FIG. 29 is a side view of the transition strip and modular blocks of FIG. 28.

A sloped transition strip 232 and a corresponding pan 242 can also be provided for the perimeter portion. See FIGS. 28 and 29. These modules can be smaller in width than the modules in the interior portion and can provide a sloped transition from the existing road surface to the top of the surface layers blocks inside the roundabout. In some embodiments, the transition strip and pan can be used as linear edge elements, such that no additional trimming is needed. In other embodiments, the transition strip and pan can have sufficient flexibility to be installed as long curved segments bordering the interior pan and surface layer blocks. A matching curve can be cut along the outer edge of the interior pan and surface layer strip blocks. Items such as reflectors, directional arrows, and solar-LED markers can be molded or otherwise embedded into or affixed to the transition strip for added visibility and traffic guidance, as noted above.

Figure 30:
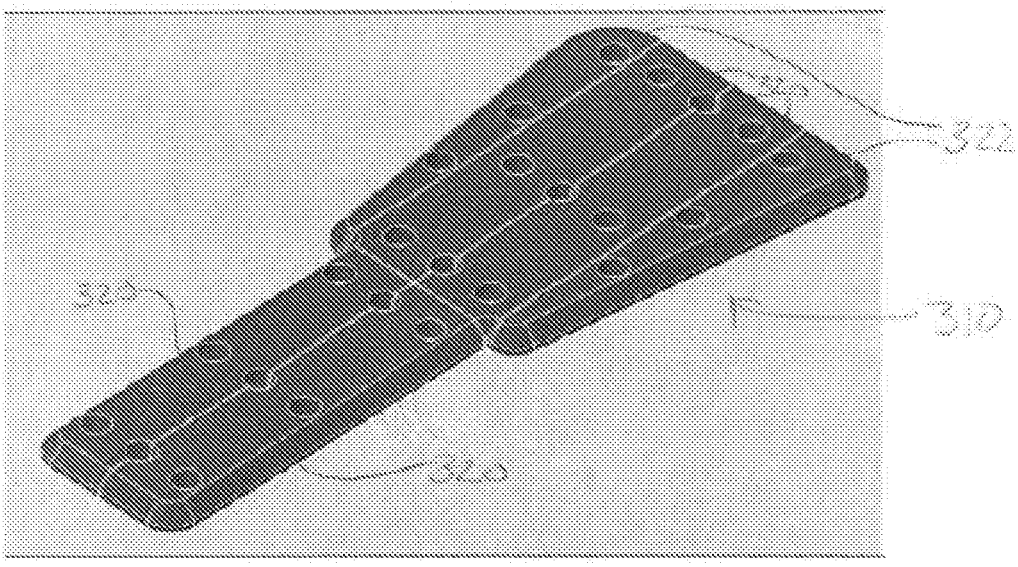
FIG. 30 is an isometric view of an embodiment of a splitter island formed from modular blocks for use with a roundabout.
Figure 31:
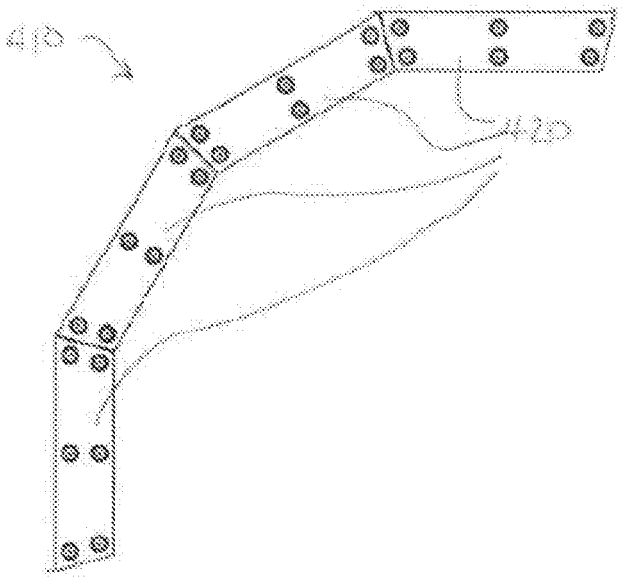
FIG. 31 is a plan view of an embodiment of curbing formed from modular blocks for use with a roundabout.

Blocks of suitable modular shapes can be combined to create features such as splitter islands, bulb-outs, corner curbs, and other demarcations associated with a roundabout, for example, to replace painted lines. These parts can require more custom cutting to trim them to the specifics of a particular installation. FIG. 30 illustrates one embodiment of a splitter island 320 from five rectangular modular blocks. A fan shape on one end of the splitter island can be provided by cutting one rectangular modular block along a diagonal line to form two blocks 322 and reversing one of the two blocks. The perimeter of the splitter island can be sloped, as shown. FIG. 31 illustrates on embodiment of curbing 410 formed from several rectangular modular blocks 420.

The modular blocks can be made from any suitable material. In some embodiments, a plastic polymer material can be used. In some embodiments, engineering polymers such as polyethylene terephthalate (PET) or polyamide (Nylon) can be used as a base polymer. In some embodiments, polyolefins such as polypropylene (PP) or polyethylene (PE) can be used as a base polymer. In some embodiments, the modular blocks can be made from recycled materials. For example, PET can be recycled from soda bottles and PP can be recycled from various consumer goods, such as food packaging and outdoor equipment.

In some embodiments, crumb rubber (CR), obtained from recycled tires, can be used as an additive to a base polymer. Many processes exist to separate metal and fiber in a tire from the rubber and transform it into crumb rubber (CR), ranging from wood chip sized particles down to a fine mesh powder, readily used as a low-cost, durable, and impact resistant additive. A compatibilizer can be used to ensure that the crumb rubber is dispersed evenly throughout the base polymer phase and to improve bonding between the material phases. Maleic anhydride grafted polyethylene (MAH) is a suitable compatibilizer with PET and CR. One suitable compatibilizer is commercially available as Epolene C-18. In some embodiments, a compatibilizer can range from about 0% to about 8%, about 2% to about 8%, about 4% to about 8%, or about 6% to about 8% by volume. A cross-linking promotor, such as dicumyl peroxide (DCP), can be used to promote cross-linking between PE and CR. In some embodiments, the cross-linking promotor can range from about 0% to about 3%, about 1% to about 3%, or about 2% to about 3% by weight of CR depending on the polyolefin used. In some embodiments, the amount of crumb rubber can range from about 0% to about 60%, about 10% to about 60%, about 20% to about 60%, about 10% to about 40%, about 10% to about 50%, about 20% to about 40%, and about 20% to about 50% by volume. In some embodiments, the CR particle size can range from about 200 mesh to about 40 mesh, and from about 200 mesh to about 30 mesh.

A thermoplastic urethane or polyurethane (TPU) can be added to improve toughness, particularly to PET. In some embodiments, the TPU can range from about 0% to about 20%, from about 5% to about 20%, about 10% to about 20%, from about 15% to about 20%, from about 0% to about 15%, from about 5% to about 15%, from about 10% to about 15% by volume.

The starting materials can be combined and pelletized. The resulting small pellets can be used as a common feedstock for thermoplastic processes, such as extrusion, to produce the stock boards from which the modular blocks are cut, or compression molding, to mold the modular blocks. In some embodiments, the starting materials can be mixed using twin screw extrusion, which combines a high degree of mixing with an ability to add multiple materials into the machine at controlled rates to produce tailored material blends. Selected ratios of constituent materials are melt-homogenized into a well-integrated mix, then extruded into a cooling bath as a continuous rod to harden. The hardened rod is then chopped into small pellets, which become the feedstock used for the subsequent thermoplastic processes.

Several compositions were formulated for testing. The formulations are shown in Table 1. Mechanical property test results are shown in Tables 2 and 3.

TABLE 1

| Sample | PET vol % | PP vol % | CR vol % | Compatibilizer vol % | TPU vol % |
|---|---|---|---|---|---|
| 1 | 100 | | 0 | 0 | 0 |
| 2 | 79 | | 19 | 2 | 0 |
| 3 | 64 | | 34 | 4 | 0 |
| 4 | 49 | | 49 | 6 | 0 |
| 5 | 42 | | 42 | 6 | 10 |
| 6 | 37 | | 37 | 6 | 20 |
| 7 | 59 | | 29 | 4 | 10 |
| 8 | 54 | | 24 | 4 | 20 |
| 8a | 74 | | 14 | 2 | 10 |
| 8b | 69 | 0 | 9 | 4 | 20 |
| 9 | 0 | 100 | 0 | | |
| 10 | 0 | 80 | 20 | | |
| 11 | 0 | 60 | 40 | | |
| 12 | 0 | 40 | 60 | | |

TABLE 2

| Sample | CR vol % | TPU vol % | Max Load (N) | Max Stress (MPa) | Strain at max | Modulus (GPa) |
|---|---|---|---|---|---|---|
| 1 | 0 | 0 | 2336 | 57.9 | 0.094 | 0.616 |
| 2 | 19 | 0 | 1185 | 29.4 | 0.070 | 0.416 |
| 3 | 34 | 0 | 575 | 14.3 | 0.041 | 0.349 |
| 4 | 49 | 0 | 283 | 7.0 | 0.032 | 0.221 |
| 7 | 29 | 10 | 601 | 14.9 | 0.049 | 0.305 |
| 8 | 24 | 20 | 599 | 14.8 | 0.054 | 0.276 |
| 8a | 14 | 10 | 1194 | 29.6 | 0.065 | 0.460 |
| 8b | 9 | 20 | 1168 | 29.0 | 0.059 | 0.487 |
| 9 | 0 | | 716 | 17.8 | 0.224 | 0.079 |
| 10 | 20 | | 737 | 18.3 | 0.204 | 0.090 |
| 11 | 40 | | 506 | 12.5 | 0.245 | 0.051 |
| 12 | 60 | | 370 | 9.2 | 0.422 | 0.022 |

TABLE 3

| Sample | Max Flex. Load (N) | Flexural stress (MPa) | Impact (1 is best) | Hardness (Shore D) |
|---|---|---|---|---|
| 1 | 103.0 | 61.3 | 1 | 75 |
| 2 | 63.2 | 37.6 | 10 | 69 |
| 3 | 39.6 | 23.6 | 12 | 62 |

TABLE 3-continued

| Sample | Max Flex. Load (N) | Flexural stress (MPa) | Impact (1 is best) | Hardness (Shore D) |
|---|---|---|---|---|
| 4 | 22.5 | 13.4 | 11 | 52 |
| 7 | 39.0 | 23.2 | 9 | 58 |
| 8 | 30.2 | 18.0 | 7 | 56 |
| 8a | 53.8 | 32.0 | 8 | 66 |
| 8b | 51.6 | 30.7 | 6 | 64 |
| 9 | 33.5 | 20.0 | 2 | 64 |
| 10 | 25.1 | 14.9 | 5 | 59 |
| 11 | 17.4 | 10.4 | 4 | 55 |
| 12 | 10.8 | 6.4 | 3 | 47 |

In some embodiments, a composition can include about 50% to about 80% by volume PET, about 20% to about 50% CR by volume, and about 2% to about 8% by volume compatibilizer. The PET can be from a recycled source.

In some embodiments, a composition can include about 30% to about 60% by volume PET, about 10% to about 40% by volume CR, about 2% to about 8% by volume compatibilizer, and about 10% to about 20% by volume TPU. The PET can be from a recycled source.

In some embodiments, a composition can include about 40% to about 80% by volume PP, about 20% to about 60% CR, and about 1% to about 3% by volume DCP. The PP can be from a recycled source.

In some embodiments, the material composition for the roundabout modules can be a combination of recycled high density polyethylene (HDPE, commonly available from recycled grocery bags and milk bottles) mixed with 30 to 60 percent recycled crumb rubber. The constituents are commonly available, readily processed into large sheets by extrusion, and provide excellent impact and other properties (including good UV resistance with the inclusion of additives to the formulation). This combination of materials is also commercially available as relatively large off-the-shelf sheets and boards that can be cut to the appropriate sizes and shapes.

Other material compositions can include one or more of a polyolefin, poly(methyl methacrylate), acrylonitrile butadiene styrene, polybutylene terephthalate, polycarbonate and polyoxymethylene.

Polymers provide advantages due to their inherent ability to be recycled, often multiple times, without substantial loss of properties. For example, thermoplastics such as polyolefins as well as impact modified plastics such as acrylonitrile butadiene styrene (ABS) exhibit minimal loss of physical properties even after several generations (>6 cycles) of recycling. It has also been observed that semi-crystalline polymers, such as PET, actually exhibit some enhanced physical properties with increased generation of 100% recycled resin, perhaps due to increase in percent crystallinity.

The materials selection for the fabrication of long-lasting, low cost roundabouts can be based on ultimate performance and service-life requirements. Properties including impact and abrasion resistance, outdoor weathering characteristics (UV stability, ozone, chemical, oil and oxidation resistance), ease of fabrication and shipping can be used to determine the particular polymer blend composition to be used for the fabrication of a roundabout. Prolonged outdoor exposure can necessitate the use of polymers containing aliphatic and predominantly saturated backbone. Ethylene-propylene rubber (EPR) is often used in applications requiring prolonged exposure to sun, oxygen and ozone. To obtain appropriate impact strength, impact modified plastics such as ABS can be included in the composition. Materials can be sourced from post-consumer recycled plastic and elastomer waste streams and blended with other virgin or recycled polymers as needed.

In some embodiments, recycled polyolefins such as HDPE, LDPE, or polyester (PET) blended with virgin or recycled ABS with a suitable type of compatibilizer can be used. Compatibilizers can include a selectively hydrogenated SEBS (styrene ethylene/butylene styrene) block copolymer. The resultant melt-blended compositions can provide a combination of good weathering resistance and impact characteristics.

Options for recycled thermoplastics can be considered in two categories: Olefin based polymers, and engineered thermoplastics. Olefins such as polyethylene (PE) and polypropylene (PP) are widely used polymers and are relatively inexpensive. They possess a high degree of toughness, chemical resistance, have low water absorption, are low density and are amenable to various forms of rapid processing. They can be somewhat sensitive to UV exposure, but are commonly used in outdoor applications when properly treated with UV additives. These materials are readily available on the recycled market. Polyolefins rely on a high molecular weight to obtain useable properties. They therefore show some degree of property degradation in a recycled form, due to the nature of processing. However, in the roundabout application, it is possible to design for reduced properties and/or include specific additives designed to improve properties, resulting in recycled plastics with properties approaching new material levels, aiding in meeting primary structural performance requirements such as axle loading.

Another category of recycled plastics, engineered thermoplastics, includes polyesters (e.g., PET), polycarbonate (PC) or polyamide (nylon) type materials. These materials, in general, have better mechanical properties than polyolefins due to their molecular structure and increased secondary bond strength. In general, these materials also have a high degree of toughness, higher temperature performance, good chemical resistance and improved UV performance (via additives). They are slightly heavier than olefins (>1 g/cc). Recycled engineering thermoplastics typically do not see as much property loss as olefins because they do not rely on a high degree of molecular weight like olefins. Polyesters, specifically, show a high propensity for recycling.

Selection of a manufacturing process can represent an optimization of factors such as raw material cost (for example, using the largest amount crumb rubber possible in the material formulation due to its lower price than recycled plastic), manufacturing throughput of extrusion compared to compression molding, and the material property changes with various mix ratios of matrix to filler. For example, if the base polymer allows high loading levels of crumb rubber, a compression molding process may be preferred due to the high viscosity of the material. Compression molding can also be used for additional components such as the plugs, which also allows the plugs to be made with a differently colored material to enhance visibility of the roundabout.

Further aspects of the invention include the following:

1. A roundabout for vehicular traffic, comprising:

a plurality of modular blocks arranged in a generally circular roundabout pattern and affixed to a roadway or ground surface at an intersection of vehicle roadways;

a first perimeter portion of the plurality of the blocks arranged to form segments of a perimeter of the roundabout; and a second interior portion of the plurality of the blocks arranged inwardly from the blocks of the first perimeter portion to form an interior of the roundabout.

2. The roundabout of item 1, wherein the modular blocks have a trapezoidal plan shape, and the blocks are arranged in concentric rings, an outermost ring forming the perimeter of the roundabout.
3. The roundabout of item 2, wherein each of the blocks in one ring of the concentric rings has a same trapezoidal shape.
4. The roundabout of any of items 2-3 wherein the modular blocks are arranged in wedges of trapezoidal blocks extending radially inwardly from the perimeter toward a central region of the roundabout.
5. The roundabout of item 4, wherein the modular blocks are arranged in 8 to 24 wedges of trapezoid blocks.
6. The roundabout of any of items 1-5, wherein at least the first perimeter portion and the second interior portion of the modular blocks have a same thickness and a same width in a radial direction.
7. The roundabout of any of items 1-6, wherein edges of the blocks along the perimeter are straight or arc-shaped.
8. The roundabout of any of items 1-7, wherein the modular blocks are formed from an elongated board having a constant width and a constant thickness, a length of the board cut into trapezoidal sections with alternating angular cuts extending across the width of the board.
9. The roundabout of any of items 1-7, wherein each of the modular blocks are molded blocks.
10. The roundabout of any of items 1-9, further comprising a third central portion of the blocks disposed in a central region of the roundabout.
11. The roundabout of item 10, wherein the central portion of the blocks are triangular.
12. The roundabout of item 10, wherein the central portion of the blocks are arranged in parallel alignment.
13. The roundabout of item 12, wherein the central portion of the blocks comprise two trapezoidal blocks in a middle area and two blocks with segmented sides arranged on opposite sides of the two middle trapezoidal blocks.
14. The roundabout of any of items 1 and 6-13, wherein the modular blocks of the interior portion are rectangular and the modular blocks of the perimeter portion have one edge formed as an arc of a circle.
15. The roundabout of any of items 1-14, wherein the roundabout has an outer diameter ranging from about 5 feet to about 120 feet.
16. The roundabout of any of items 1-15, wherein the modular blocks are arranged on the roadway or ground surface with an upper surface configured to drain water away from a central region of the roundabout.
17. The roundabout of any of items 1-16, wherein the modular blocks have varying thicknesses, and blocks of greater thickness are arranged radially inwardly of blocks of lesser thickness.
18. The roundabout of any of items 1-17, wherein the modular blocks are removably fastened to the roadway or ground surface.
19. The roundabout of any of items 1-18, wherein the modular blocks are fastened to the roadway or ground surface with a plurality of ground anchors.
20. The roundabout of item 19, wherein each of the ground anchors comprises a hollow insert fixed with a grout material within a hole in the roadway or ground surface, and a bolt extending through an opening in one of the modular blocks into the hollow insert.
21. The roundabout of item 20, wherein the opening in the modular block is filled with a plug, the bolt extending through the plug.
22. The roundabout of item 21, wherein the plug is has a truncated conical or pyramidal shape.
23. The roundabout of item 21, wherein the plug has an arrow shape, the arrow shape oriented in a direction to direct traffic flow in a circular pattern around the roundabout.
24. The roundabout of any of items 21-23, wherein the plug is formed with a color that contrasts with a color of the modular blocks or is formed from a reflective material.
25. The roundabout of any of items 1-24, further comprising drainage channels formed in upper surfaces, lower surfaces, or upper and lower surfaces of the modular blocks arranged to direct water away from a central region of the roundabout.
26. The roundabout of any of items 1-25, wherein a central region of the roundabout is free of modular blocks.
27. The roundabout of any of items 1-26, wherein a central region of the roundabout is filled with one or more of a paving material and plantings.
28. The roundabout of any of items 1-27, wherein the modular blocks are formed of a recycled plastic material.
29. The roundabout of any of items 1-28, wherein the modular blocks are formed of a composition comprising a polyethylene terephthalate and recycled crumb rubber from tires.
30. The roundabout of any of items 1-28, wherein the modular blocks are formed of a composition comprising a polypropylene and recycled crumb rubber from tires.
31. The roundabout of any of items 1-30, wherein the modular blocks comprise crumb rubber from tires ranging from 0% to 60% by volume.
32. The roundabout of any of items 1-31, further comprising one or more of a splitter island and curbing at the intersection formed from modular blocks.
33. A modular block system for a roundabout for vehicular traffic, comprising:

a plurality of modular blocks configured to be disposed in a generally circular roundabout pattern and affixed to a roadway or ground surface at an intersection of vehicle roadways;

a first perimeter portion of the plurality of the blocks configured to form segments of a perimeter of the roundabout; and a second interior portion of the plurality of the blocks configured to form an interior of the roundabout inwardly from the blocks of the first perimeter portion.

34. The system of item 33, wherein the modular blocks have a trapezoidal plan shape, and the blocks are configured to be disposed in concentric rings, an outermost ring forming the perimeter of the roundabout.
35. The system of item 34, wherein each of the blocks in one ring of the concentric rings has a same trapezoidal shape.
36. The system of any of items 34-35, wherein the modular blocks are configured to form wedges of trapezoidal blocks extending radially inwardly from the perimeter toward a central region of the roundabout.
37. The system of any of items 34-36, wherein the modular blocks are configured to form 8 to 24 wedges of trapezoid blocks.
38. The system of any of items 33-37, wherein at least the first perimeter portion and the second interior portion of the modular blocks have a same thickness and a same width in a radial direction.

39. The system of any of items 33-38, wherein edges of the blocks along the perimeter are straight or arc-shaped.
40. The system of any of items 33-39, wherein the modular blocks are formed from an elongated board having a constant width and a constant thickness, a length of the board cut into trapezoidal sections with alternating angular cuts extending across the width of the board.
41. The system of any of items 33-39, wherein each of the modular blocks is a molded block.
42. The system of any of items 33-41, further comprising a third central portion of the blocks configured to be disposed in a central region of the roundabout.
43. The system of item 42, wherein the central portion of the blocks are triangular.
44. The system of item 42, wherein the central portion of the blocks are arranged in parallel alignment.
45. The system of any of items 42 and 44, wherein the central portion of the blocks comprise trapezoidal blocks configured for a middle area and blocks with segmented sides configured for opposite sides of the middle trapezoidal blocks.
46. The system of any of items 33-45, wherein the modular blocks of the interior portion are rectangular and the modular blocks of the perimeter portion have one edge formed as an arc of the circle.
47. The system of any of items 33-46, wherein the roundabout has an outer diameter ranging from about 5 feet to about 120 feet.
48. The system of any of items 33-47, wherein the modular blocks are configured to provide an upper surface configured to drain water away from a central region of the roundabout.
49. The system of any of items 33-48, wherein the modular blocks have varying thicknesses, with blocks of greater thickness configured to be disposed radially inwardly of blocks of lesser thickness.
50. The system of any of items 33-49, wherein the modular blocks are removably fastened to a support surface.
51. The system of any of items 33-50, further comprising a plurality of ground anchors to fasten the modular blocks to a support surface.
52. The system of item 51, wherein each of the ground anchors comprises a hollow insert fixable with a grout material within a hole in the support surface, and a bolt extending through an opening in one of the modular blocks into the hollow insert.
53. The system of item 52, further comprising a plug configured to fit within the opening in the modular block, the bolt extending through the plug.
54. The system of item 53, wherein the plug is has a truncated conical or pyramidal shape.
55. The system of item 53, wherein the plug has an arrow shape, the arrow shape oriented in a direction to direct traffic flow in a circular pattern around the roundabout.
56. The system of any of items 53-55, wherein the plug is formed with a color that contrasts with a color of the modular blocks or is formed from a reflective material.
57. The system of any of items 33-56, further comprising drainage channels formed in upper surfaces, lower surfaces, or upper and lower surfaces of the modular blocks arranged to direct water away from a central region of the roundabout.
58. The system of any of items 33-57, wherein the modular blocks are formed of a recycled plastic material.
59. The system of any of items 33-58, wherein the modular blocks are formed of a composition comprising a polyethylene terephthalate and recycled crumb rubber from tires.
60. The system of any of items 33-58, wherein the modular blocks are formed of a composition comprising a polypropylene and recycled crumb rubber from tires.
61. The system of any of items 33-60, wherein the modular blocks comprise crumb rubber from tires ranging from 0% to 60% by volume.
62. A roundabout kit comprising:

the plurality of modular blocks of the system of any of items 33-61, at least a portion of the blocks each having a trapezoidal shape, the blocks configured to form a generally circular roundabout pattern for control of vehicular traffic; and a plurality of ground anchors.

63. A roundabout kit comprising:

a plurality of modular blocks configured to be disposed in a generally circular roundabout pattern and affixed to a roadway or ground surface at an intersection of vehicle roadways;

a first perimeter portion of the plurality of the blocks configured to form segments of a perimeter of the roundabout; and a second interior portion of the plurality of the blocks configured to form an interior of the roundabout inwardly from the blocks of the first perimeter portion.

64. The roundabout kit of item 63, wherein the modular blocks have a trapezoidal plan shape and the blocks are configured to be disposed in concentric rings, an outermost ring forming the perimeter of the roundabout.
65. The roundabout kit of any of items 63-64, further comprising a plurality of ground anchors.
66. A method of making a roundabout, comprising:

providing the modular block system of any of items 33-61; and affixing the plurality of modular blocks to a roadway or ground surface at an intersection of vehicle roadways.

67. The method of item 66, wherein the step of providing the modular block system comprises:

providing an elongated board having a constant width and a constant thickness, and cutting the board across the width into trapezoidal sections with alternating angular cuts.

68. The method of item 67, further comprising forming openings in each trapezoidal section at locations to receive a fastener.
69. The method of item 66, wherein the step of providing the modular block system comprises molding each of the modular blocks.
70. A method of making a roundabout, comprising:

affixing a plurality of modular blocks in a generally circular roundabout pattern to a roadway or ground surface at an intersection of vehicle roadways, the modular blocks arranged with a first perimeter portion of the plurality of the blocks configured to form segments of a perimeter of the roundabout; and a second interior portion of the plurality of the blocks configured to form an interior of the roundabout inwardly from the blocks of the first perimeter portion.

71. The method of item 70, wherein the modular blocks are trapezoidal in plan shape and are arranged in concentric rings, an outermost ring forming the perimeter of the roundabout.
72. The method of any of items 70-71, wherein the modular blocks are affixed to the roadway or ground surface with ground anchors.

73. The method of any of items 70-72, further comprising forming one or more of a splitter island and curbing at the intersection.

74. A method of making a roundabout for vehicular traffic, comprising:

providing an elongated board having a constant width and a constant thickness;

cutting a length of the board across the width into trapezoidal sections with alternating angular cuts; and fastening the trapezoidal sections in a generally circular pattern of concentric rings to a surface at an intersection of vehicle roadways.

75. The method of item 74, further comprising forming openings in each trapezoidal section at locations to receive a fastener.

As used herein, "consisting essentially of" allows the inclusion of materials or steps that do not materially affect the basic and novel characteristics of the claim. Any recitation herein of the term "comprising," particularly in a description of components of a composition or in a description of elements of a device, can be exchanged with "consisting essentially of" or "consisting of."

It will be appreciated that the various features of the embodiments described herein can be combined in a variety of ways. For example, a feature described in conjunction with one embodiment may be included in another embodiment even if not explicitly described in conjunction with that embodiment.

To the extent that the appended claims have been drafted without multiple dependencies, this has been done only to accommodate formal requirements in jurisdictions which do not allow such multiple dependencies. It should be noted that all possible combinations of features which would be implied by rendering the claims multiply dependent are explicitly envisaged and should be considered part of the invention.

The present invention has been described in conjunction with certain preferred embodiments. It is to be understood that the invention is not limited to the exact details of construction, operation, exact materials or embodiments shown and described, and that various modifications, substitutions of equivalents, alterations to the compositions, and other changes to the embodiments disclosed herein will be apparent to one of skill in the art.

What is claimed is:

1. A roundabout for vehicular traffic, comprising:

a plurality of modular blocks arranged in a generally circular roundabout pattern and affixed to a roadway or ground surface at an intersection of vehicle roadways;

a first perimeter portion of the plurality of the blocks arranged to form segments of a perimeter of the roundabout; and a second interior portion of the plurality of the blocks arranged inwardly from the blocks of the first perimeter portion to form an interior of the roundabout; and wherein the blocks are arranged in concentric rings, an outermost ring forming the perimeter of the roundabout, and each of the blocks in at least one ring of the concentric rings has a trapezoidal plan shape.

2. The roundabout of claim 1, wherein all of the modular blocks in the concentric rings have a trapezoidal plan shape.

3. The roundabout of claim 1, wherein the modular blocks are arranged in wedges of trapezoidal blocks extending radially inwardly from the perimeter toward a central region of the roundabout.

4. The roundabout of claim 1, wherein the modular blocks having the trapezoidal shape comprise sections of an elongated board having opposed planar surfaces having a constant width and a constant thickness between the opposed surfaces, a length of the board cut into trapezoidal sections with angular cuts extending across the width of the board, the trapezoidal sections arranged on the surface with either one of the opposed planar surfaces oriented upwardly.

5. The roundabout of claim 1, wherein each of the modular blocks are molded blocks.

6. The roundabout of claim 1, further comprising a third central portion of the blocks disposed in a central region of the roundabout.

7. The roundabout of claim 6, wherein the central portion of the blocks are arranged in parallel alignment and comprise two trapezoidal blocks in a middle area and two blocks with segmented sides arranged on opposite sides of the middle trapezoidal blocks in the middle area.

8. The roundabout of claim 1, wherein the modular blocks of the interior portion are rectangular and the modular blocks of the perimeter portion have one edge formed as an arc of a circle.

9. The roundabout of claim 1, wherein the roundabout has an outer diameter ranging from about 5 feet to about 120 feet.

10. The roundabout of claim 1, wherein the modular blocks are arranged on the roadway or ground surface with an upper surface configured to drain water away from a central region of the roundabout.

11. The roundabout of claim 1, wherein the modular blocks are fastened to the roadway or ground surface with a plurality of ground anchors.

12. The roundabout of claim 11, wherein each of the ground anchors comprises a hollow insert fixed with a grout material within a hole in the roadway or ground surface, and a bolt extending through an opening in or along an edge of one of the modular blocks into the hollow insert.

13. The roundabout of claim 12, wherein the opening in or along the modular block is filled with a plug, the bolt extending through the plug.

14. The roundabout of claim 1, wherein the modular blocks are removably fastened to the roadway or ground surface.

15. The roundabout of claim 1, wherein a central region of the roundabout is free of modular blocks.

16. The roundabout of claim 1, wherein the modular blocks are formed of a recycled plastic material.

17. The roundabout of claim 1, wherein the modular blocks are formed of a composition comprising a polyethylene terephthalate and recycled crumb rubber from tires.

18. The roundabout of claim 1, wherein the modular blocks are formed of a composition comprising a polypropylene and recycled crumb rubber from tires.

19. The roundabout of claim 1, further comprising one or more of a splitter island and curbing at the intersection formed from modular blocks.

20. A modular block system for a roundabout for vehicular traffic, comprising:

a plurality of modular blocks configured to be disposed in a generally circular roundabout pattern and affixed to a roadway or ground surface at an intersection of vehicle roadways;

a first perimeter portion of the plurality of the blocks configured to form segments of a perimeter of the roundabout; and a second interior portion of the plurality of the blocks configured to form an interior of the roundabout inwardly from the blocks of the first perimeter portion;

wherein the blocks are configured for arrangement in concentric rings, an outermost ring forming the perimeter of the roundabout, and each of the blocks in at least one ring of the concentric rings has a trapezoidal plan shape.

21. A roundabout kit comprising:

a plurality of modular blocks configured to be disposed in a generally circular roundabout pattern and affixed to a roadway or ground surface at an intersection of vehicle roadways;

a first perimeter portion of the plurality of the blocks configured to form segments of a perimeter of the roundabout; and a second interior portion of the plurality of the blocks configured to form an interior of the roundabout inwardly from the blocks of the first perimeter portion;

wherein the blocks are configured for arrangement in concentric rings, an outermost ring forming the perimeter of the roundabout, and each of the blocks in at least one ring of the concentric rings has a trapezoidal plan shape.

22. The roundabout kit of claim 21, wherein all of the modular blocks configured for arrangement in the concentric rings have a trapezoidal plan shape.

23. The roundabout kit of claim 21, further comprising a plurality of ground anchors.

24. A method of making a roundabout, comprising:

affixing a plurality of modular blocks in a generally circular roundabout pattern to a roadway or ground surface at an intersection of vehicle roadways, the modular blocks arranged with a first perimeter portion of the plurality of the blocks configured to form segments of a perimeter of the roundabout, and a second interior portion of the plurality of the blocks configured to form an interior of the roundabout inwardly from the blocks of the first perimeter portion;

wherein the blocks are arranged in concentric rings, an outermost ring forming the perimeter of the roundabout, and each of the blocks in at least one ring of the concentric rings has a trapezoidal plan shape.

25. The method of claim 24, wherein all of the modular blocks arrangement in the concentric rings are trapezoidal in plan shape.

26. The method of claim 24, wherein the modular blocks are affixed to the roadway or ground surface with ground anchors.

27. The method of claim 24, further comprising forming one or more of a splitter island and curbing at the intersection.

* * * * *